US009649838B2

(12) United States Patent
Takano et al.

(10) Patent No.: US 9,649,838 B2
(45) Date of Patent: May 16, 2017

(54) INSPECTION METHOD OF LIQUID DISCHARGE HEAD AND LIQUID DISCHARGE DEVICE

(71) Applicant: SEIKO EPSON CORPORATION, Tokyo (JP)

(72) Inventors: Koji Takano, Shiojiri (JP); Masako Fukuda, Shiojiri (JP); Toshiyuki Suzuki, Matsumoto (JP); Satoshi Shimizu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/993,481

(22) Filed: Jan. 12, 2016

(65) Prior Publication Data

US 2016/0207340 A1 Jul. 21, 2016

(30) Foreign Application Priority Data

Jan. 19, 2015 (JP) ..... 2015-007387
Nov. 19, 2015 (JP) ..... 2015-226569

(51) Int. Cl.
*B41J 2/045* (2006.01)
*B41J 29/393* (2006.01)

(52) U.S. Cl.
CPC ..... *B41J 2/0451* (2013.01); *B41J 2/04581* (2013.01); *B41J 2/04588* (2013.01); *B41J 2/04596* (2013.01); *B41J 29/393* (2013.01)

(58) Field of Classification Search
CPC .. B41J 2/0451; B41J 2/04596; B41J 2/04588; B41J 2/04581; B41J 29/393
See application file for complete search history.

(56) References Cited

U.S. PATENT DOCUMENTS 7,300,131 B2 * 11/2007 Sakagami ..... B41J 2/0451 347/19
8,783,821 B2 * 7/2014 Suzuki ..... B41J 2/0451 347/19

(Continued)

FOREIGN PATENT DOCUMENTS

JP 2008183797 A * 8/2008
JP 2011-201170 A 10/2011
JP 2013-233656 A 11/2013

OTHER PUBLICATIONS

Extended European Search Report mailed Aug. 22, 2016 in related EP Appl. 16151806.3 (4 pgs.).

*Primary Examiner* — Julian Huffman
*Assistant Examiner* — Sharon A Polk
(74) *Attorney, Agent, or Firm* — Foley & Lardner LLP

(57) ABSTRACT

Inspection processing is performed. The inspection processing includes a first driving step of driving a piezoelectric element corresponding to an inspection target nozzle, a first detection step of detecting vibration that is generated in ink in a pressure chamber corresponding to the inspection target nozzle by the driving in the first driving step, a second driving step of driving together the piezoelectric element corresponding to the inspection target nozzle and a piezoelectric element corresponding to at least one nozzle of nozzles adjacent to the inspection target nozzle, and a second detection step of detecting vibration that is generated in the ink in the pressure chamber corresponding to the inspection target nozzle by the driving in the second driving step.

10 Claims, 12 Drawing Sheets

(56) References Cited

U.S. PATENT DOCUMENTS

| | | | | |
|---|---|---|---|---|
| 8,857,948 | B2 * | 10/2014 | Suzuki | B41J 2/04541 347/14 |
| 9,327,536 | B2 * | 5/2016 | Suzuki | B41J 29/393 |
| 9,393,779 | B2 * | 7/2016 | Takagi | B41J 2/04541 |
| 2005/0212845 | A1 * | 9/2005 | Shinkawa | B41J 2/0451 347/19 |
| 2009/0085985 | A1 | 4/2009 | Matsuzawa | |
| 2011/0234700 | A1 | 9/2011 | Kobayashi et al. | |
| 2012/0206532 | A1 | 8/2012 | Kim et al. | |
| 2013/0135400 | A1 | 5/2013 | Yazaki et al. | |
| 2013/0293610 | A1 | 11/2013 | Suzuki et al. | |

* cited by examiner

FIG. 10

| DRIVING METHOD | | | DETECTION ACCURACY | | |
|---|---|---|---|---|---|
| | | | LOW | MEDIUM | HIGH |
| A | INSPECTION TARGET NOZZLE | DRIVE WAVEFORM | Pd | Pd | Pd |
| | | DRIVE VOLTAGE | SMALL | MEDIUM | LARGE |
| | ASSIST NOZZLE | DRIVE WAVEFORM | Pd | Pd | Pd |
| | | DRIVE VOLTAGE | – | – | – |
| | | THE NUMBER OF NOZZLES | 2 | 2 | 2 |
| B | INSPECTION TARGET NOZZLE | DRIVE WAVEFORM | Pv | Ps | Pd |
| | | DRIVE VOLTAGE | – | – | – |
| | ASSIST NOZZLE | DRIVE WAVEFORM | Pv | Pv | Pv |
| | | DRIVE VOLTAGE | – | – | – |
| | | THE NUMBER OF NOZZLES | 2 | 2 | 2 |
| C | INSPECTION TARGET NOZZLE | DRIVE WAVEFORM | Pd | Pd | Pd |
| | | DRIVE VOLTAGE | – | – | – |
| | ASSIST NOZZLE | DRIVE WAVEFORM | Pv | Pv | Pv |
| | | DRIVE VOLTAGE | SMALL | MEDIUM | LARGE |
| | | THE NUMBER OF NOZZLES | 2 | 2 | 2 |
| D | INSPECTION TARGET NOZZLE | DRIVE WAVEFORM | Pd | Pd | Pd |
| | | DRIVE VOLTAGE | SMALL | MEDIUM | LARGE |
| | ASSIST NOZZLE | DRIVE WAVEFORM | Pd | Pd | Pd |
| | | DRIVE VOLTAGE | SMALL | MEDIUM | LARGE |
| | | THE NUMBER OF NOZZLES | 2 | 2 | 2 |
| E | INSPECTION TARGET NOZZLE | DRIVE WAVEFORM | Pd | Pd | Pd |
| | | DRIVE VOLTAGE | SMALL | LARGE | LARGE |
| | ASSIST NOZZLE | DRIVE WAVEFORM | Pd | Pd | Pd |
| | | DRIVE VOLTAGE | SMALL | LARGE | LARGE |
| | | THE NUMBER OF NOZZLES | 2 | 2 | 4 |

INSPECTION METHOD OF LIQUID DISCHARGE HEAD AND LIQUID DISCHARGE DEVICE

BACKGROUND

1. Technical Field

The present invention relates to an inspection method of a liquid discharge head such as an ink jet type recording head and a liquid discharge device, in particular to an inspection method of a liquid discharge head that discharge liquid from nozzles by generating pressure vibration in liquid in pressure chambers connected to the nozzles by driving of actuators and a liquid discharge device.

2. Related Art

The liquid discharge device is a device which includes a liquid discharge head that can discharge liquid as droplets from nozzles and discharges various liquids from the liquid discharge head. A typical example of the liquid discharge device is an image recording device such as an ink jet type recording device (printer) which includes an ink jet type recording head (hereinafter referred to as a recording head) and performs recording by discharging liquid ink as droplets from nozzles of the recording head. Further, a liquid discharge device is used to discharge various types of liquids such as a color material used for a color filter of a liquid crystal display or the like, an organic material used for an organic EL (Electro Luminescence) display, and an electrode material used to form an electrode. A recording head for an image recording device discharges liquid ink. A color material discharge head for a display manufacturing device discharges liquid solution of each color material of R (Red), G (Green), and B (Blue). An electrode material discharge head for an electrode forming device discharges an electrode material in a liquid state. A living organic material discharge head for a chip manufacturing device discharges liquid solution of living organic material.

As the liquid discharge head described above, there is a liquid discharge head formed by stacking a plurality of members such as a nozzle plate where nozzles are formed, a substrate where pressure chambers are formed, an elastic film that partitions a part of the pressure chambers, and actuators that cause pressure vibration in the pressure chambers (for example, see JP-A-2011-201170). For example, constituent members such as the nozzle plate and the substrate where the pressure chambers are formed are joined together by an adhesive. When the adhesive degrades and separation between members occurs, in particular, when vertical separation occurs in a partition wall that partitions the pressure chamber, there is a risk that problems occur, such as liquid leaks from a separated portion and liquid is not normally discharged from nozzles because pressure loss occurs when the liquid is discharged. Therefore, JP-A-2011-201170 proposes a configuration in which the nozzle plate is prevented from being separated from a flow path formation substrate.

In related art, it is possible to detect trouble in discharging liquid due to thickening of the liquid and/or bubbles. However, there is a problem that when separation or the like occurs due to aging or the like, it is difficult to detect the separation as distinguished from the trouble in discharging liquid due to thickening of the liquid or the like.

The invention is made in view of the above situation and an object of the invention is to provide an inspection method of a liquid discharge head and a liquid discharge device, where it is possible to detect separation between a partition wall that partitions a pressure chamber and a constituent member joined to the partition wall.

SUMMARY

An inspection method of a liquid discharge head according to an aspect of the invention is an inspection method of a liquid discharge head including a liquid discharge head which has a plurality of nozzles arranged in parallel, a substrate in which a plurality of pressure chambers respectively communicating with the nozzles are formed by being separated by partition walls, and actuators that cause pressure vibration in liquid in the pressure chambers and which discharges liquid from the nozzles by driving of the actuators, and a detection circuit that detects vibration in the liquid in the pressure chamber generated by the driving of the actuator. The inspection method performs inspection processing including a first driving step of driving a first actuator corresponding to an inspection target nozzle, a first detection step of detecting vibration that is generated in liquid in a pressure chamber corresponding to the inspection target nozzle by the driving in the first driving step, a second driving step of driving together the first actuator and a second actuator corresponding to at least one nozzle of nozzles adjacent to the inspection target nozzle, a second detection step of detecting vibration that is generated in the liquid in the pressure chamber corresponding to the inspection target nozzle by the driving in the second driving step, and a separation detection step of detecting separation of a member joined to the partition wall based on a difference between a detection result of the first detection step and a detection result of the second detection step.

According to the configuration described above, separation of a member joined to the partition wall is detected based on the first driving step of driving a first actuator corresponding to an inspection target nozzle, the first detection step of detecting vibration that is generated in liquid in a pressure chamber corresponding to the inspection target nozzle by the driving in the first driving step, the second driving step of driving together the first actuator and a second actuator corresponding to at least one nozzle of nozzles adjacent to the inspection target nozzle, the second detection step of detecting vibration that is generated in the liquid in the pressure chamber corresponding to the inspection target nozzle by the driving in the second driving step, and the difference between a detection result of the first detection step and a detection result of the second detection step. Therefore, it is possible to more reliably detect the separation of a member, which has been difficult to detect separately from a trouble of discharge due to thickening. In the configuration described above, it is preferable that the inspection processing is performed when an accumulated load related to generation of the separation exceeds a predetermined determination value.

According to this configuration, the inspection processing is performed when the accumulated load related to the generation of the separation exceed a predetermined determination value, so that it is possible not to perform the inspection processing in an initial stage in which the possibility of the generation of the separation is relatively small. Therefore, it is possible to reduce the processing time accordingly. Further, when liquid is discharged from the nozzles in the inspection processing, it is possible to reduce useless consumption of the liquid.

Further, in the configuration described above, it is desirable that the greater the accumulated load, the greater the number of the second actuators that are driven together with the first actuator of the inspection target nozzle in the second driving step.

According to this configuration, it is possible to efficiently detect the separation while suppressing useless consumption of the liquid in a case in which the liquid is discharged from the nozzles in the inspection processing. In other words, the smaller the accumulated load, the smaller the possibility of generation of separation, so that when the number of the second actuators driven along with the first actuator of the inspection target nozzle is reduced, it is possible to accordingly reduce the amount of liquid consumed in the inspection processing. On the other hand, the greater the accumulated load, the higher the possibility of generation of separation. Therefore, by increasing the number of the second actuators driven along with the first actuator of the inspection target nozzle in the second driving step, it is possible to further prevent bending of the partition walls that partitions the pressure chamber corresponding to the inspection target nozzle when driving the first actuator, so that it is possible to improve the detection accuracy of the separation.

In the configuration described above, it is preferable that the smaller the accumulated load, the relatively greater an allowable error in determination of separation in the separation detection step described above, and the greater the accumulated load, the relatively smaller an allowable error in determination of separation in the separation detection step described above.

According to this configuration, the smaller the accumulated load, the smaller the possibility that a separation occurs, so that false detection is suppressed by setting a relatively large allowable error in determination of separation in the separation detection step. On the other hand, the greater the accumulated load, the greater the possibility that a separation occurs, so that it is possible to improve the detection accuracy of the separation by setting a relatively small allowable error in determination of separation in the separation detection step.

In each configuration described above, it is preferable that the separation detection step includes a warning step of issuing a warning to a user when a separation is detected in the separation detection step.

According to this configuration, the user can immediately know that the separation occurs, so that it is possible to quickly perform a countermeasure such as repair and replacement.

In each configuration described above, it is preferable that when the actuators are driven in the first driving step and the second driving step, liquid is discharged from nozzles corresponding to the actuators.

According to this configuration, when driving the actuators in the first driving step and the second driving step, liquid is discharged from nozzles corresponding to the actuators, so that it is possible to apply a larger vibration to the liquid in the pressure chambers. Therefore, the detection accuracy is improved.

A liquid discharge device of the invention is a liquid discharge device including, a liquid discharge head having a plurality of nozzles arranged in parallel, a substrate in which a plurality of pressure chambers respectively communicating with the nozzles are formed by being separated by partition walls, and actuators that cause pressure vibration in liquid in the pressure chambers, a detection circuit that detects vibration in the liquid in the pressure chamber generated by driving of the actuator, and a control circuit that controls discharge of liquid from the nozzles by driving the actuators, wherein the control circuit drives a first actuator corresponding to an inspection target nozzle and detects vibration generated in liquid in a pressure chamber corresponding to the inspection target nozzle as a first detection result, drives together the first actuator and a second actuator corresponding to at least one nozzle of nozzles adjacent to the inspection target nozzle and detects vibration generated in the liquid in the pressure chamber corresponding to the inspection target nozzle as a second detection result, and detects separation of a member joined to the partition wall based on a difference between the first detection result and the second detection result.

BRIEF DESCRIPTION OF THE DRAWINGS

The invention will be described with reference to the accompanying drawings, wherein like numbers reference like elements.

FIG. 10 is a table showing a specific example of the inspection processing in the second embodiment.

DESCRIPTION OF EXEMPLARY EMBODIMENTS

Hereinafter, a first embodiment for implementing the invention will be described with reference to the attached drawings. In the embodiments described below, various limitations are imposed as preferable specific examples. However, the scope of the invention is not limited to the embodiments unless there is a particular description to limit the invention in the following description. Hereinafter, as a liquid discharge device of the invention, an ink jet type recording device (hereinafter, printer) will be described as an example.

Figure 1:
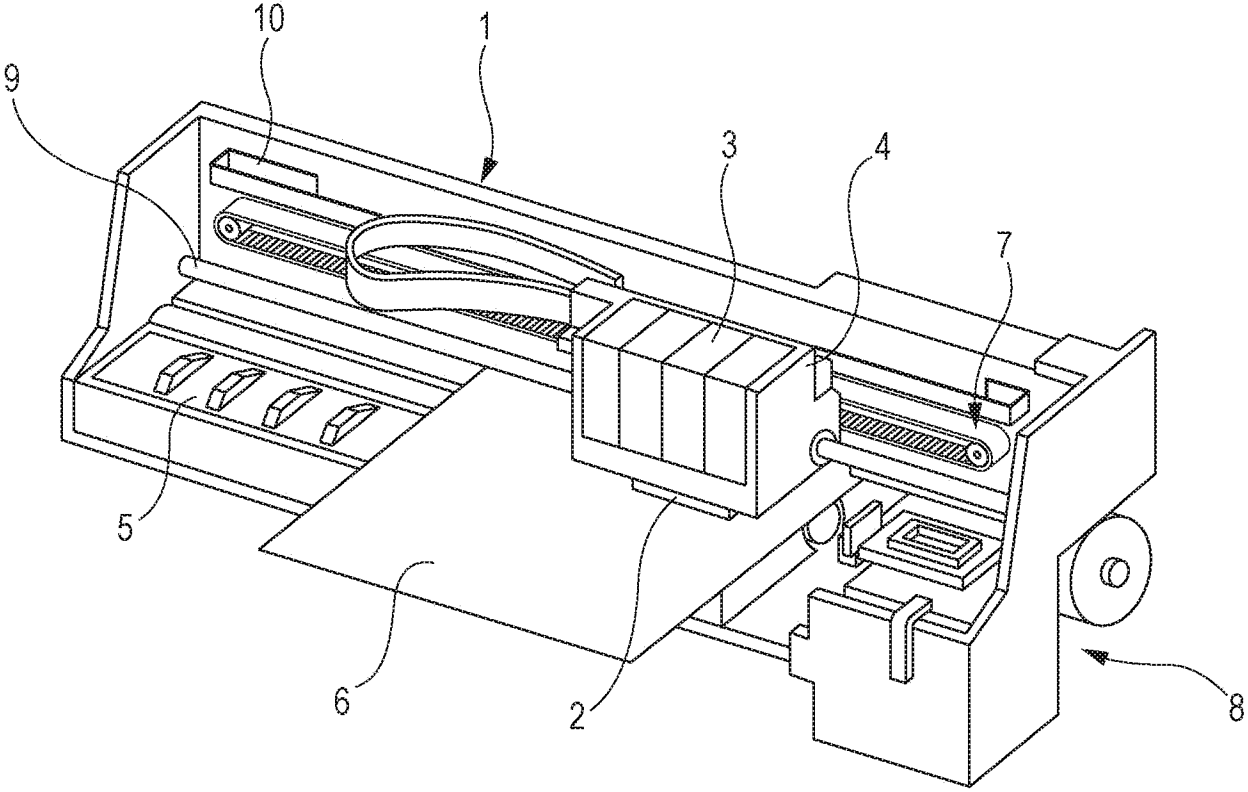
FIG. 1 is a perspective view illustrating an internal configuration of a printer.

FIG. 1 is a perspective view showing a configuration of a printer 1. The printer 1 is roughly composed of a carriage 4 to which a recording head 2 that is a kind of a liquid discharge head is attached and to which an ink cartridge 3 that is a kind of a liquid supply source is attachably and detachably attached, a platen 5 arranged below the recording head 2 which is performing a recording operation, a carriage moving mechanism 7 that reciprocates the carriage 4 in a paper width direction of a recording paper 6 (a kind of a recording medium and a hitting target), that is, a main scanning direction, and a paper feed mechanism 8 that transports the recording paper 6 in a sub-scanning direction perpendicular to the main scanning direction. It is also possible to employ a configuration in which the ink cartridge 3 is arranged in a main body of the printer 1 and ink is supplied from the ink cartridge 7 to the recording head 2 through an ink supply tube.

The carriage 4 is attached to a guide rod 9 in a state in which the carriage 4 is pivotally supported by the guide rod 9 installed along the main scanning direction and is configured to move in the main scanning direction along the guide rod 9 by an operation of the carriage moving mechanism 7. A position of the carriage 4 in the main scanning direction is detected by a linear encoder 10 and a detection signal of the position is transmitted to a CPU 35 of a printer controller 31 (see FIG. 3). The linear encoder 10 outputs an encoder pulse according to a scanning position of the recording head 2 as position information in the main scanning direction. Therefore, the CPU 35 can recognize the scanning position of the recording head 2 mounted on the carriage 4 based on the received encoder pulse. Thereby, the CPU 35 can control a recording operation of the recording head 2 while recognizing the scanning position of the carriage 4 (the recording head 2) based on the encoder pulse from the linear encoder 10. The printer 1 is configured to be able to perform so-called bi-directional recording, in which characters and images are recorded on the recording paper 6 bi-directionally, that is, characters and images are recorded when the carriage 4 moves forwardly from a home position to an opposite end portion and when the carriage 4 moves backwardly from the opposite end portion to the home position.

Figure 2A:
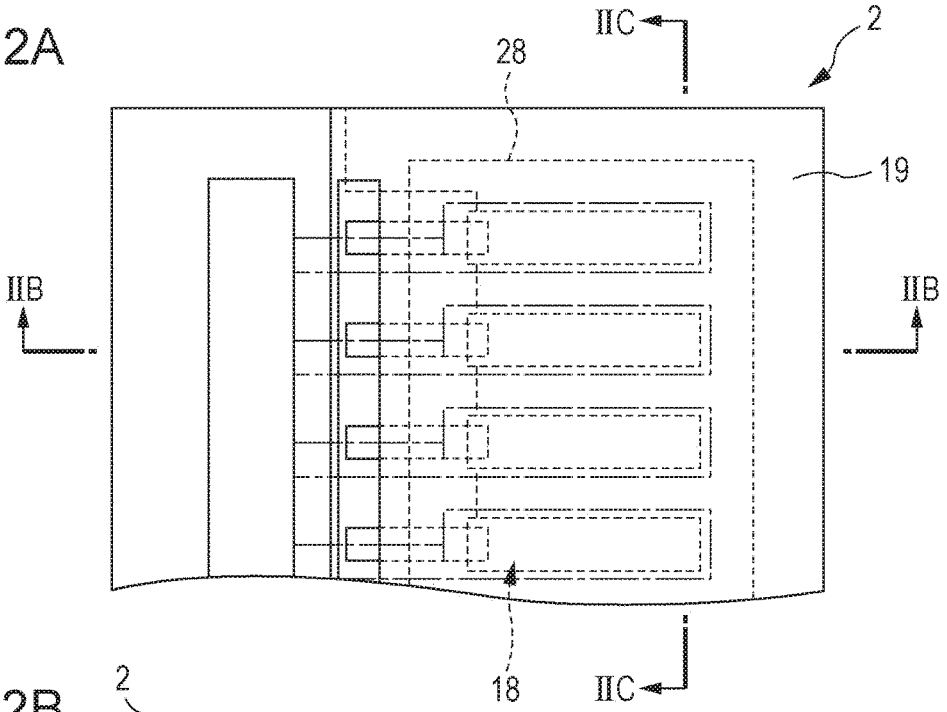
FIGS. 2A to 2C are diagrams illustrating a configuration of a recording head.
Figure 2B:
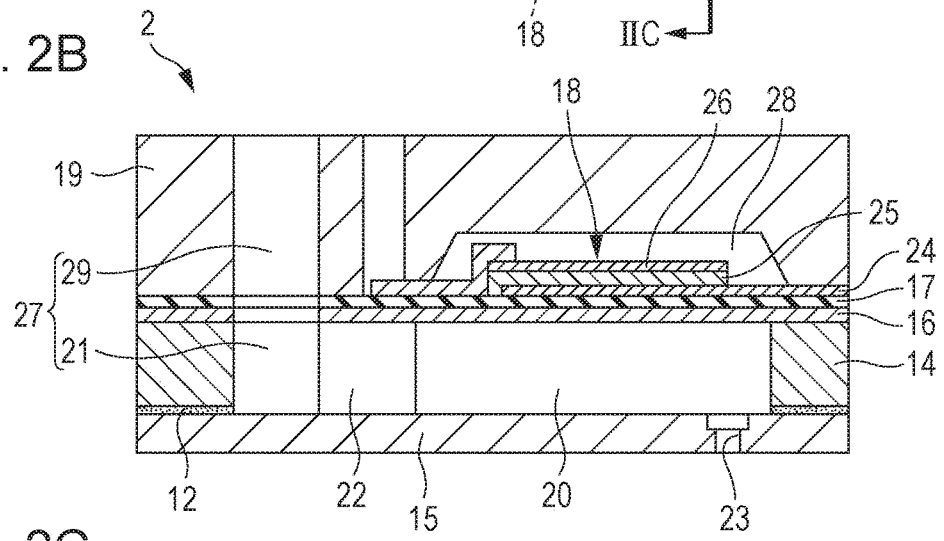
Figure 2C:
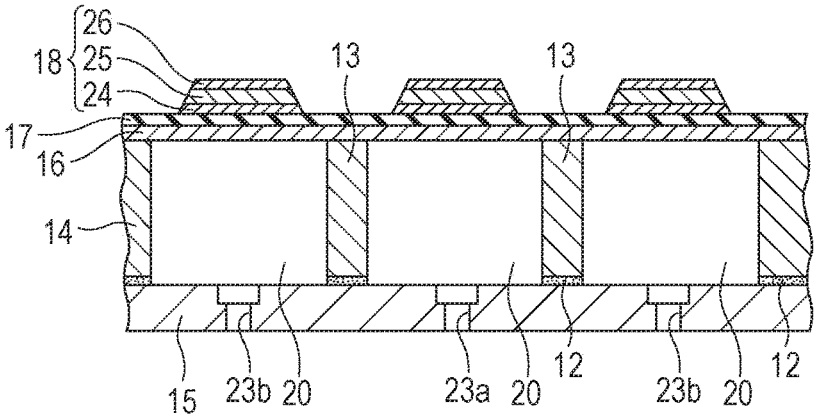

FIGS. 2A to 2C are diagrams showing a configuration of the recording head 2 of the embodiment. FIG. 2A is a plan view of the recording head 2. FIG. 2B is a cross-sectional view taken along line IIB-IIB in FIG. 2A. FIG. 2C is a cross-sectional view taken along line IIC-IIC in FIG. 2A. In FIG. 2C, a protective substrate 19 is omitted. While FIGS. 2A, 2B, and 2C illustrate a configuration of three nozzles, a configuration of the other nozzles is the same as the configuration of the three nozzles. The recording head 2 of the embodiment is configured by stacking a pressure chamber substrate 14, a nozzle plate 15, an elastic film 16, an insulating film 17, a piezoelectric element 18, a protective substrate 19, and the like.

The pressure chamber substrate 14 is a plate formed of, for example, a silicon single crystal substrate. In the pressure chamber substrate 14, a plurality of pressure chambers 20 are arranged in a width direction (a nozzle array direction) of the pressure chamber substrate 14 with partition walls 13 in between. In the embodiment, 360 pressure chambers 20 per inch are formed. A communication portion 21 is formed in a region outside a region opposite to a region communicating with a nozzle 23 in a longitudinal direction of the pressure chamber 20 (a direction perpendicular to the nozzle array direction) in the pressure chamber substrate 14, and the communication portion 21 and each pressure chamber 20 are communicated with each other through an ink supply path 22 provided for each pressure chamber 20. The communication portion 21 communicates with a reservoir portion 29 of the protective substrate 19 described later and forms a part of a reservoir 27 which is a common ink chamber of each pressure chamber 20. The ink supply path 22 is formed with a width smaller than that of the pressure chamber 20, so that the ink supply path applies a flow path resistance to ink flowing from the communication portion 21 into the pressure chamber 20. The pressure chambers 20 and the ink supply paths 22 in the pressure chamber substrate 14 are formed by anisotropic etching.

The nozzle plate 15 in which a plurality of nozzles 23 are formed in a row corresponding to the pressure chambers 20 is joined to a lower surface of the pressure chamber substrate 14 with an adhesive 12. Thereby, a lower opening of the pressure chamber 20 is sealed by the nozzle plate 15 and a bottom portion of the pressure chamber 20 is formed. The elastic film 16 formed of, for example, silicon dioxide ($SiO_2$) is formed on an upper surface of the pressure chamber substrate 14. A portion of the elastic film 16 that seals the opening of the pressure chamber 20 functions as an actuating surface. The insulating film 17 formed of zirconium oxide ($ZrO_2$) is formed on the elastic film 16, and further a lower electrode 24, a piezoelectric body 25, and an upper electrode 26 are formed on the insulating film 17, so that the piezoelectric element 18 (a kind of actuator in the invention) is formed in a state in which the above films and the like are laminated.

In general, one of the two electrodes of the piezoelectric element 18 is used as a common electrode of a plurality of piezoelectric elements 18, and the other electrode (individual electrode) and the piezoelectric body 25 are patterned and formed for each pressure chamber 20. A portion where a piezoelectric strain is generated by applying a voltage to both electrodes functions as a piezoelectric body active portion. In the embodiment, the lower electrode 24 is used as a common electrode of the piezoelectric elements 18 and the upper electrode 26 is used as an individual electrode of the piezoelectric element 18. However, it is possible to employ a configuration in which the lower electrode 24 and the upper electrode 26 are used in the opposite way for the convenience of a polarization direction of the piezoelectric body 25, a drive circuit, wiring, and the like. In either case, the piezoelectric body active portion is formed for each pressure chamber 20.

The protective substrate 19 including a piezoelectric element holding portion 28, which is a space having an appropriate size so as not to block displacement of the piezoelectric element 18, in a region facing the piezoelectric element 18 is joined to a surface over the pressure chamber substrate 14 facing the piezoelectric element 18. Further, the protective substrate 19 is provided with the reservoir portion 29 in a region corresponding to the communication portion 21 in the pressure chamber substrate 14. The reservoir portion 29 is formed in the protective substrate 19 as a through hole having a long rectangular opening shape along a direction in which the pressure chambers 20 are arranged. The reservoir portion 29 is communicated with the communication portion 21 in the pressure chamber substrate 14 to form the reservoir 27. The reservoir 27 is provided for each type of ink (for each color) and common ink is stored in a plurality of pressure chambers 20.

The recording head 2 having a configuration described above receives ink from the ink cartridge 3, and portions from the reservoir 27 to the nozzles 23 are filled with the ink. When a drive signal is supplied from the printer main body, an electric field according to an electric potential difference between the lower electrode 24 and the upper electrode 26 corresponding to the pressure chamber 20 is applied between both electrodes, and the piezoelectric element 18 and the actuating surface (the elastic film 16) are bent and deformed, so that pressure variation occurs in the pressure chamber 20. By controlling the pressure variation, ink is discharged from the nozzle 23 or a meniscus on the nozzle 23 is finely vibrated in a degree that the ink is not discharged.

Figure 3:
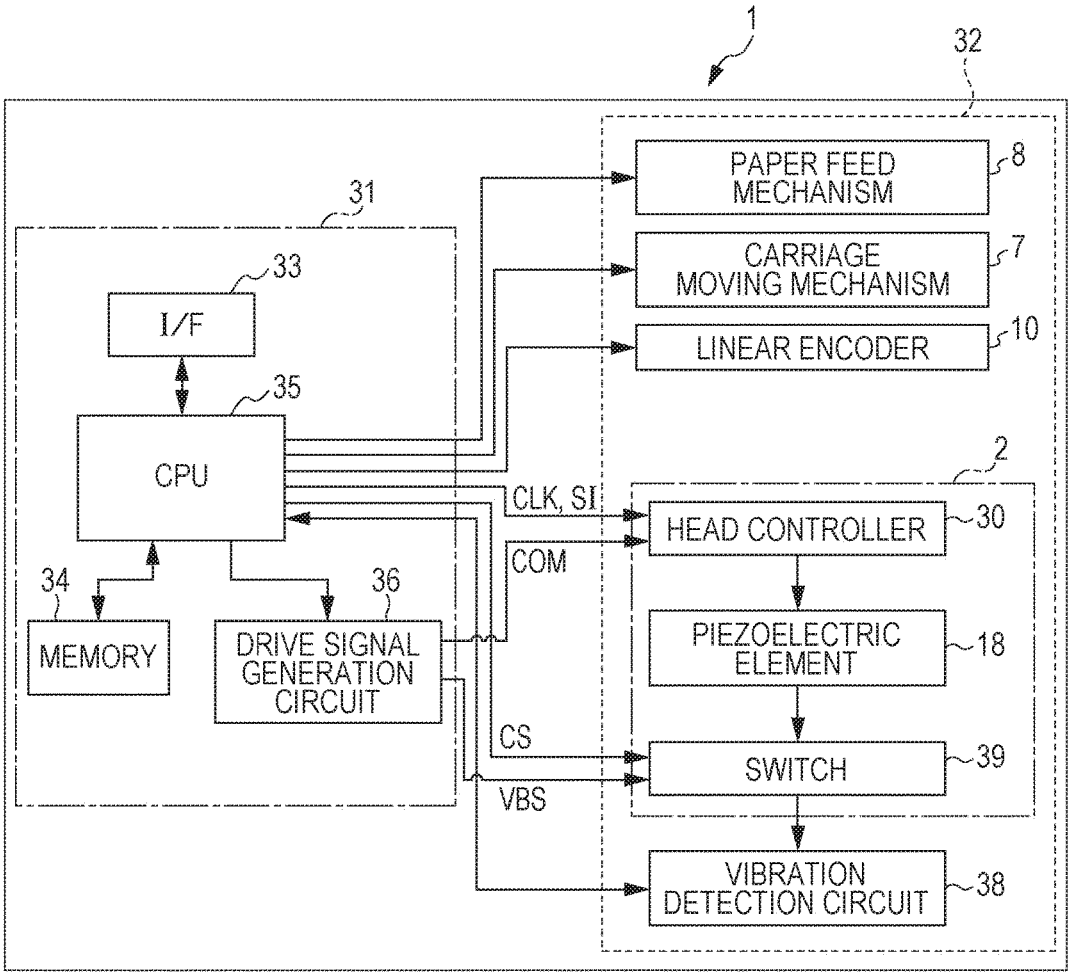
FIG. 3 is a block diagram illustrating an electrical configuration of the printer.

FIG. 3 is a block diagram showing an electrical configuration of the printer 1. The printer 1 of the embodiment schematically includes a printer controller 31 and a print engine 32. The printer controller 31 includes an external interface (external I/F) 33 to which print data and the like are inputted from an external device such as a host computer, a memory 34 that stores a control program and the like for various controls and various data and the like, a CPU 35 that performs integral control of each component according to the control program stored in the memory 34, and a drive signal generation circuit 36 that generates a drive signal to be supplied to the recording head 2. The print engine 32 includes the recording head 2, the carriage moving mechanism 7, the paper feed mechanism 8, the linear encoder 10, and a vibration detection circuit 38.

The drive signal generation circuit 36 includes a drive voltage supply source and a constant voltage supply source (none of them are shown), outputs a drive signal COM from the drive voltage supply source, and outputs a direct voltage VBS from the constant voltage supply source. The drive voltage supply source is electrically connected to the upper electrode 26 which is a drive electrode of the piezoelectric element 18 through a pulse selection switch 37 (see FIGS. 5A to 6B) provided for each piezoelectric element 18. The constant voltage supply source is electrically connected to the lower electrode 24 which is the common electrode of the piezoelectric elements 18 through a switch 39 provided in common to the piezoelectric elements 18 belonging to the same nozzle array and a detection resistor 40 connected in parallel with the switch 39 (see FIGS. 5A to 6B).

The head controller 30 of the recording head 2 performs discharge control of ink (a kind of liquid in the invention) based on gradation data SI transmitted from the printer controller 31. In the embodiment, the gradation data SI including two bits is transmitted in synchronization with a clock signal and is sequentially inputted into a sift register and a latch circuit not shown in the drawings in the head controller 30. Then the latched gradation data SI is outputted to a decoder not shown in the drawings. The decoder generates pulse gradation data for selecting a drive pulse included in the drive signal COM based on an upper bit group and a lower bit group of recording data.

The drive signal COM from the drive signal generation circuit 36 is supplied to the head controller 30. The drive signal COM is inputted into the pulse selection switch 37 of the head controller 30 (see FIGS. 5A to 6B). The upper electrode 26 of the piezoelectric element 18 is connected to an output side of the pulse selection switch 37. The pulse selection switch 37 selectively applies the drive pulse included in the drive signal COM to the piezoelectric element 18 based on the pulse gradation data. The pulse selection switch 37 that performs the operation as described above functions as a kind of a selective supply means. Further, the pulse selection switch 37 also functions as a kind of switching mechanism that switches between a connected state and a disconnected state of the piezoelectric element 18 to the drive signal generation circuit 36 when inspection processing described later is performed. An operation of the pulse selection switch 37 in the inspection processing will be described later.

The vibration detection circuit 38 is connected to the lower electrode 24 of the piezoelectric element 18 through the switch 39. The switch 39 is controlled and switched according to a switching signal CS outputted from the CPU 35. The vibration detection circuit 38 is configured to output a counter electromotive force signal of the piezoelectric element 18 based on vibration (residual vibration) generated in the ink in the pressure chamber when the piezoelectric element 18 is driven by an inspection drive pulse Pd (see FIG. 4) to the printer controller 31 as a detection signal. The CPU 35 of the printer controller 31 inspects the presence or absence of failure of the recording head 2 based on the counter electromotive force signal outputted from the vibration detection circuit 38. Therefore, the vibration detection circuit 38 and the printer controller 31 function as a detection circuit in the invention and detect vibration of ink in the pressure chamber by using the piezoelectric element 18 as a vibration sensor.

The printer 1 according to the invention starts inspection processing and performs inspection processing of the recording head 2 when a predetermined inspection execution condition is satisfied. The failure of the recording head 2 means a state in which a separation occurs between the pressure chamber substrate 14 in which the pressure chambers 20 are formed and another member joined to the pressure chamber substrate 14, that is, the nozzle plate 15 or the elastic film 16 in the embodiment. Further, the "state in which a separation occurs" includes a state in which an adhesive force is significantly reduced to affect the discharge of ink even though complete separation does not occur. In particular, when the separation occurs at an upper end surface (at a side opposite to the nozzle plate) of the partition wall 13 that separates the pressure chambers 20 from each other or at a lower end surface (at a side of the nozzle plate) of the partition wall 13, the upper end surface or the lower end surface of the partition wall 13, whose motion is restricted before the separation, is released, so that the partition wall 13 is easily displaced or bent according to an inner pressure of the pressure chamber 20 when the inner pressure changes. Thereby, a part of the pressure used to discharge ink from the nozzle 23 is used to displace the partition wall 13. As a result, the amount of ink discharged from the nozzle 23 and a flying speed of the ink significantly decrease with respect to target values, and in a worst case, there is a risk that a discharge failure occurs in which the ink is not discharged. Such a state is defined as a failure.

It is possible to arbitrarily set the inspection execution condition mentioned above. Specifically, the inspection execution condition may be a condition in which an accumulated value of loads directly or indirectly related to generation of the separation described above (accumulated loads in the invention), more specifically, an operating time of the printer 1 (for example, an integrated value of operating time in which the ink is discharged from the nozzles 23), the number of times of discharge (an integrated value of a sum or an average of the number of times of discharge of all the nozzles), a total number of printed recording media, or the like exceeds a predetermined determination value. The greater the value of these accumulated loads is, the higher the possibility of generation of the separation is. It is desirable to weight these accumulated loads by a usage environment, that is, environment temperature and humidity. For example, when the printer is used under an environment where the environment temperature and humidity are relatively high, it is desirable to set so that the inspection processing is performed in an earlier stage by weighting the accumulated loads such as the integrated values of actual operating time and the number of times of discharge (to be greater than actual values). Alternatively, the determination value may be changed according to the usage environment instead of performing weighting. In addition, in this type of printer, an inspection about discharge failure due to thickening of ink may be performed, and the inspection execution condition may be defined as a time when an inspection result of the discharge failure due to the thickening becomes a result where the separation is suspected (the discharge failure inspection has been performed by various methods, and the detailed description thereof is omitted). Further, the inspection execution condition may be defined as a time when a user issues an execution instruction of the inspection processing through a printer driver or the like. Hereinafter, the inspection processing of the recording head 2 when the inspection execution condition is satisfied will be described.

Figure 4:
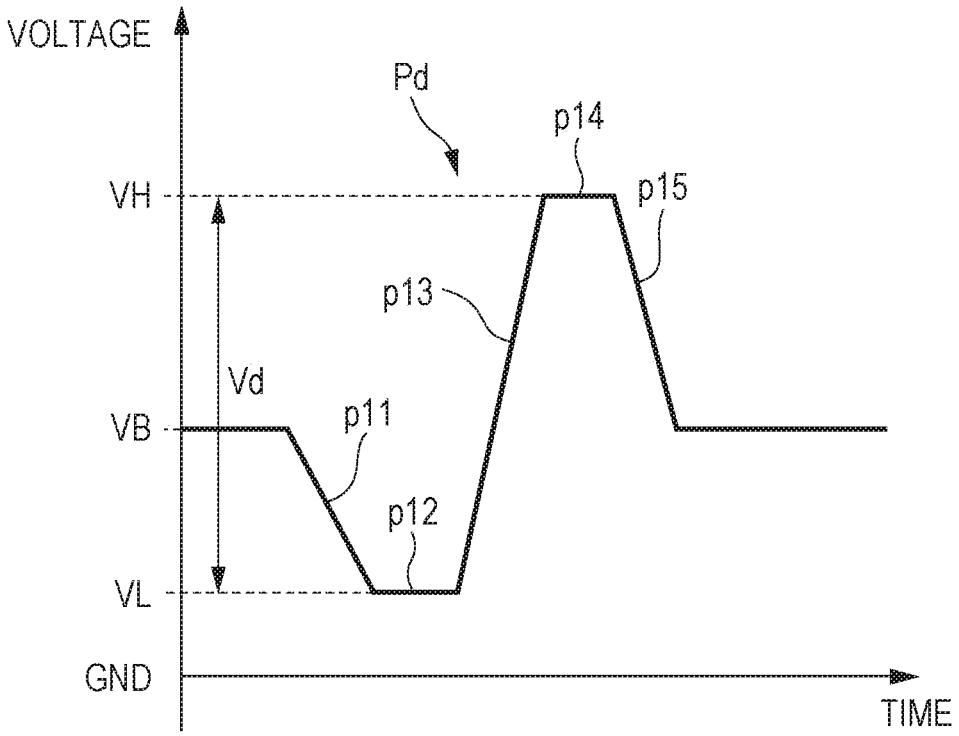
FIG. 4 is a waveform chart illustrating a configuration of an inspection drive pulse.
Figure 5A:
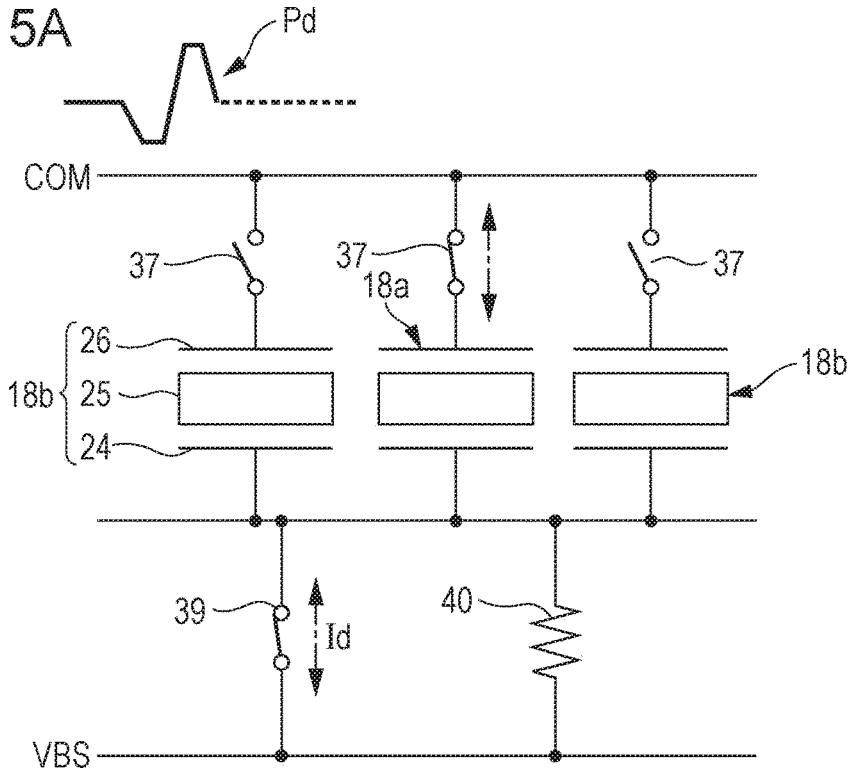
FIGS. 5A and 5B are diagrams illustrating a circuit configuration for detecting a failure of the recording head.
Figure 5B:
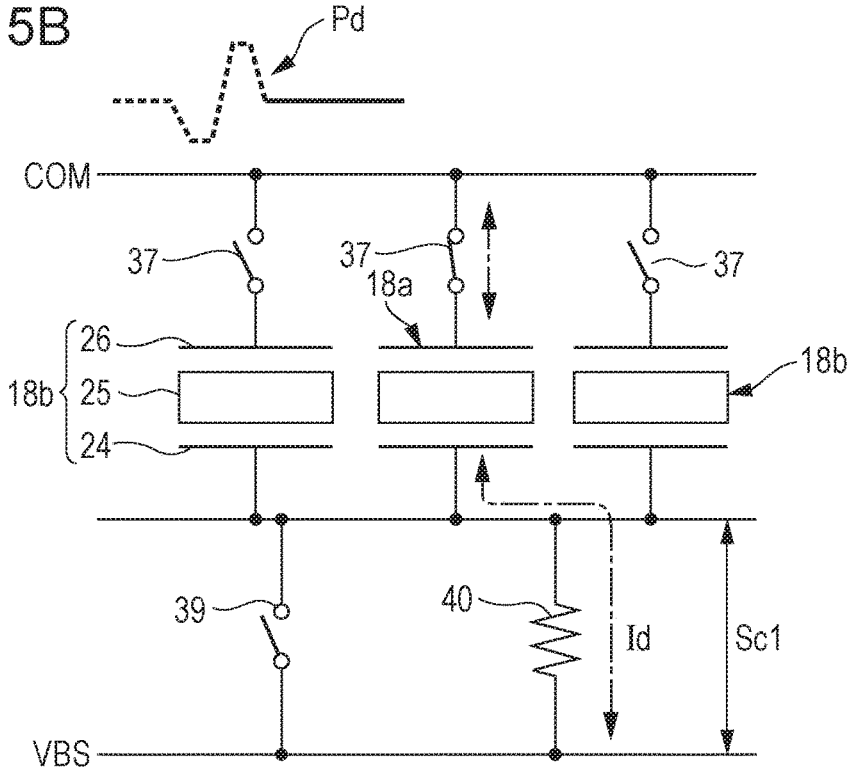

When the printer controller 31 determines that the inspection execution condition is established, that is, determines that the accumulated loads exceeds a predetermined determination value, the printer controller 31 proceeds to the inspection processing, selects an inspection target nozzle from among all the nozzles 23 of the recording head 2, and performs the inspection processing based on a counter electromotive force generated in a piezoelectric element 18 corresponding to the inspection target nozzle when applying an inspection drive pulse shown in FIGS. 5A and 5B to the piezoelectric element 18. Regarding the selection of the inspection target nozzle, for example, the printer controller 31 may sequentially select nozzles from a nozzle located at one end of the nozzle array to a nozzle located at the other end or may select a nozzle located at a position where the separation is suspected based on a result of the inspection of the discharge failure due to thickening as described above. As the inspection drive pulse, a pulse with various waveforms can be employed if the pulse can apply a pressure change to the ink in the pressure chamber 20. However, in the embodiment, the inspection drive pulse Pd shown in FIG. 4 is used.

FIG. 4 is a waveform chart of the inspection drive pulse Pd. The inspection drive pulse Pd in the embodiment includes a preliminary expansion element p11, an expansion hold element p12, a contraction element p13, a contraction hold element p14, and a return element p15. The preliminary expansion element p11 is a waveform element where the potential changes toward a ground potential GND from a reference potential VB to an expansion potential VL. The expansion hold element p12 is a waveform element where the expansion potential VL which is a terminal potential of the preliminary expansion element p11 is maintained for a certain period of time. The contraction element p13 is a waveform element where the potential changes toward the plus side with a relatively steep gradient from the expansion potential VL to the contraction potential VH through the reference potential VB. In the embodiment, a potential difference Vdl from the expansion potential VL to the contraction potential VH and the gradient of the potential change of the contraction element p13 are set so that the ink can be discharged from the nozzle 23. The contraction hold element p14 is a waveform element where the contraction potential VH is maintained for a predetermined period of time. The return element p15 is a waveform element where the potential returns from the contraction potential VH to the reference potential VB. As the inspection drive pulse Pd, a drive pulse for printing can be diverted or a pulse dedicated to the inspection processing can be used.

When the inspection drive pulse Pd formed as described above is applied to the piezoelectric element 18, first, the piezoelectric element 18 is bent to the outside of the pressure chamber 20 (to the side away from the nozzle plate 15) by the preliminary expansion element p11 and accordingly the pressure chamber 20 expands from a reference volume corresponding to the reference potential VB to an expansion volume corresponding to the expansion potential VL. By this expansion, the meniscus of the ink in the nozzle 23 is drawn toward the pressure chamber 20 from a standby position (a position of the meniscus when the pressure chamber 20 is maintained at the reference volume) along a nozzle axis direction. Then, the expansion state of the pressure chamber 20 is maintained for a certain period of time by the expansion hold element p12. After a hold by the expansion hold element p12, the piezoelectric element 18 is bent inside the pressure chamber 20 (toward the nozzle plate 15) by the contraction element p13. Accordingly, the pressure chamber 20 is rapidly contracted from the expansion volume to a contraction volume corresponding to the contraction potential VH. Thereby, the ink in the pressure chamber 20 is pressed and the meniscus drawn toward the pressure chamber 20 is pushed out to a discharge side opposite to the pressure chamber 20 over the standby position along the nozzle axis direction. Thereby, an ink droplet is discharged from the nozzle 23. Subsequently, the return element p15 is applied, so that the piezoelectric element 18 returns to a regular position corresponding to the reference potential VB. Accordingly, the pressure chamber 20 expands and returns from the contraction volume to the reference volume corresponding to the reference potential VB. Thereby, the meniscus is drawn toward the pressure chamber again. The inspection drive pulse Pd of the embodiment is formed to generate a relatively large pressure variation in the ink in the pressure chamber 20, so that the ink is discharged from the nozzle 23. However, the ink need not necessarily be discharged from the nozzle 23. However, in a driving step in the inspection processing described later, when the piezoelectric element 18 is driven by the inspection drive pulse Pd, the ink is be discharged from the nozzle 23 corresponding to the piezoelectric element 18, so that a larger vibration can be applied to the ink in the pressure chamber. Therefore, the detection accuracy is improved.

Figure 6A:
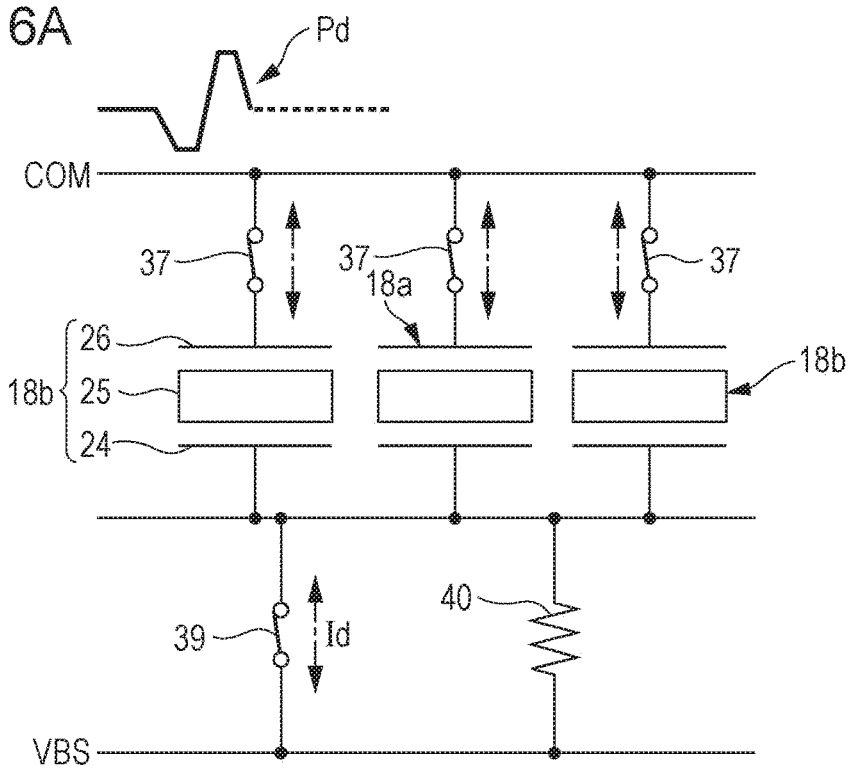
FIGS. 6A and 6B are diagrams illustrating a circuit configuration for detecting a failure of the recording head.
Figure 6B:
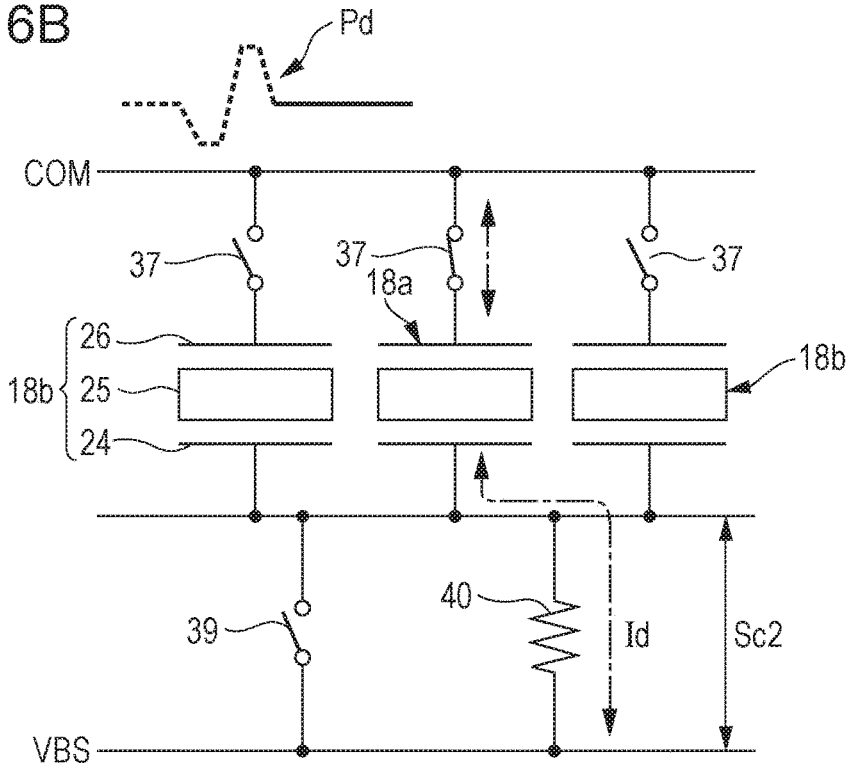

FIGS. 5A to 6B are diagrams illustrating a circuit configuration for detecting a failure of the recording head 2 based on the counter electromotive force signal of the piezoelectric element 18. FIGS. 5A and 5B show a case of a single inspection in which only an inspection target nozzle is driven. FIGS. 6A and 6B show a case of an assist inspection in which an inspection target nozzle and nozzles (assist nozzles) adjacent to the inspection target nozzle are driven. FIGS. 5A to 6B illustrate a configuration of three nozzles and omit a configuration of other nozzles 23. However, the number of the piezoelectric elements 18 and the pulse selection switches 37 is the same as the number of the nozzles 23 included in the same nozzle array. In FIGS. 5A to 6B, the central piezoelectric element 18 is a piezoelectric element 18*a* (a first actuator) corresponding to the inspection target nozzle, and the piezoelectric elements 18 on both sides of the central piezoelectric element 18 are piezoelectric elements 18*b* (second actuators) corresponding to the assist nozzles adjacent to the inspection target nozzle.

As described above, the drive voltage supply source of the drive signal generation circuit 36 is connected to the upper electrode 26 of the piezoelectric element 18 through the pulse selection switch 37 for each piezoelectric element 18 and the constant voltage supply source is electrically connected to the lower electrode 24 of the piezoelectric elements 18 through the switch 39 and the detection resistor 40 connected in parallel with the switch 39. The switch 39 is formed of, for example, MOS-FET and is switched to on while the inspection drive pulse Pd is being applied (pressure vibration generation section) (FIGS. 5A and 6A). In this case, a current (high frequency component) flows through the switch 39. On the other hand, the switch 39 is switched to off in a detection section in a time period t6 in a time period T2 (FIGS. 5B and 6B). In this case, a current Id flows through the detection resistor 40.

Here, after the piezoelectric element 18 is driven by the inspection drive pulse Pd, the actuating surface (the elastic film 16) that seals an upper opening of the pressure chamber 20 vibrates according to pressure vibration generated in the ink in the pressure chamber 20. Accordingly, damped vibration (residual vibration) is generated in the piezoelectric element 18 and a counter electromotive force based on the residual vibration is generated. The vibration detection circuit 38 obtains a counter electromotive force signal Sc (a detection signal) of the piezoelectric element 18 by amplifying and binarizing a potential difference between both ends of the detection resistor 40 described above. In an abnormal case such as a case of so-called dot omission where ink is not discharged from the nozzle 23 and a case where even when ink is discharged from the nozzle 23, the amount of discharged ink and the flying speed of the ink significantly decrease as compared with a normal nozzle 23, a periodic component, an amplitude component, and a phase component of the detection signal described above are different from those in a normal case. A detection method of the discharge failure based on the counter electromotive force signal Sc has been well known, so that the detailed description is omitted. However, by this detection method, it is possible to detect the discharge failure due to thickening of ink and bubbles.

By the way, when a separation occurs between the pressure chamber substrate 14 and another member joined to the pressure chamber substrate 14, that is, the nozzle plate 15 or the elastic film 16 in the embodiment, or when a joining force significantly decreases even though no separation occurs, in the same manner as when the ink is thickened and/or bubbles are mixed, the amount of ink and the flying speed of ink decrease as compared with a case of a normal nozzle 23. However, it is difficult to know a difference between an inspection result obtained when the separation or the like occurs and an inspection result obtained when the discharge failure occurs due to the thickening of ink and/or the bubbles, so that there has been a problem that it is difficult to detect the separation. On this point, the printer 1 according to the invention is characterized by detecting the separation described above based on a difference between a detection signal detected when only the piezoelectric element 18*a* corresponding to an inspection target nozzle is driven and a detection signal detected when the piezoelectric element 18*a* corresponding to the inspection target nozzle 23*a* and at least a piezoelectric element 18*b* corresponding to a nozzle (an assist nozzle) 23*b* adjacent to the inspection target nozzle 23*a* are driven at the same time. Here, the assist nozzle means a nozzle driven at the same time as the inspection target nozzle 23*a* in an assist inspection described later, that is, a nozzle 23*b* that is driven by applying the inspection drive pulse Pd to a corresponding piezoelectric element 18*b*, so that the assist nozzle does not necessarily means only nozzles adjacent to the inspection target nozzle 23*a*.

As described above, in the printer 1 according to the invention, the single inspection in which the inspection is performed by driving only the inspection target nozzle 23*a* (single driving) and the assist inspection in which the inspection target nozzle 23*a* and the assist nozzles 23*b* are driven at the same time (assist driving) are performed. When a nozzle 23 located at an end of a nozzle array is selected as the inspection target nozzle 23*a*, an adjacent nozzle 23 is located on only one side of the inspection target nozzle 23*a*, so that in this case, the adjacent nozzle 23 on one side is used as the assist nozzle 23*b*. In short, at least one of the nozzles 23 adjacent to the inspection target nozzle 23*a* in a nozzle array direction is defined as the assist nozzle 23*b*. In the description below, the inspection is performed by driving a total of three piezoelectric elements including the piezoelectric element 18 corresponding to the inspection target nozzle and the piezoelectric elements 18 corresponding to the assist nozzles on both sides of the inspection target nozzle. However, four or more assist nozzles may be driven. This will be described later.

Figure 7:
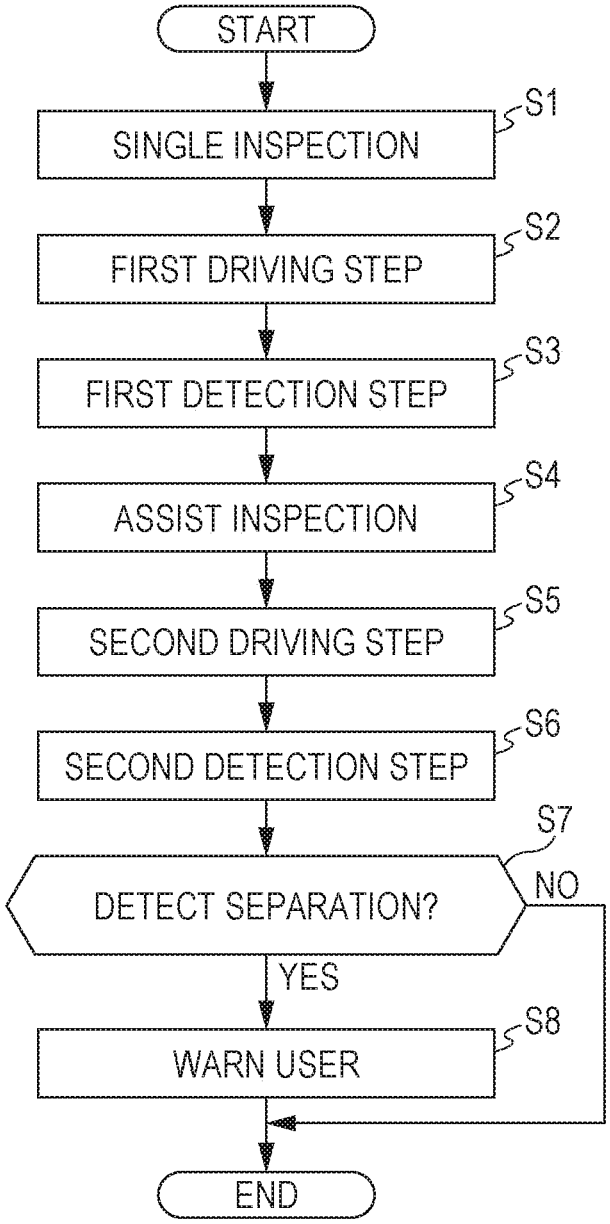
FIG. 7 is a flowchart illustrating inspection processing.

FIG. 7 is a flowchart illustrating the inspection processing. In the inspection processing, first, the single inspection is performed (step S1). Here, in FIGS. 5A and 5B, the central piezoelectric element 18 is the piezoelectric element 18*a* corresponding to the inspection target nozzle 23*a*, and the piezoelectric elements 18 on both sides of the piezoelectric element 18*a* are the piezoelectric elements 18*b* corresponding to the assist nozzles 23*b*. In the single inspection, the switch 39 is turned on by a switching signal, and only the pulse selection switch 37 of the piezoelectric element 18*a* corresponding to the inspection target nozzle 23*a* is turned on (FIG. 5A). The pulse selection switches 37 of the piezoelectric elements 18 corresponding to the other nozzles 23 (including the assist nozzles 23*b*) other than the inspection target nozzle 23*a* are turned off.

The inspection drive pulse Pd is applied to the piezoelectric element 18*a* corresponding to the inspection target nozzle 23*a*. Thereby, only the piezoelectric element 18*a* corresponding to the inspection target nozzle 23*a* is driven (a first driving step (step S2)). Thereby, pressure variation occurs in the pressure chamber 20 corresponding to the inspection target nozzle. In association with damped vibration (residual vibration) of the pressure variation, the actuating surface of the pressure chamber 20 and the piezoelectric element 18*a* also vibrate and a counter electromotive force is generated in the piezoelectric element 18*a* by the vibration. Immediately after the inspection drive pulse Pd is applied, the switch 39 is switched to off by the switching signal (FIG. 5B). Thereby, a current Id (high frequency component) based on the counter electromotive force of the piezoelectric element 18*a* corresponding to the inspection target nozzle 23*a* flows through the detection resistor 40. Then, the vibration detection circuit 38 detects a first counter electromotive force signal Sc1 as a vibration generated by the drive from a potential difference between both ends of the detection resistor 40 described above (a first detection step (step S3)). The first counter electromotive force signal Sc1 is outputted to the CPU 35 of the printer controller 31. Here, if a separation occurs on at least one of the upper and lower ends of the partition wall 13 that partitions the pressure chamber 20 of the inspection target nozzle 23*a*, the partition wall 13 easily bends when an inner pressure of the pressure chamber 20 rises, so that the pressure decreases accordingly. Thereby, the pressure variation that occurs in the pressure chamber 20 corresponding to the inspection target nozzle becomes smaller than that in a normal case (when no separation occurs). As a result, the effects of this appear in an amplitude component and the like of the first counter electromotive force signal Sc1.

Subsequently, the assist inspection is performed (step S4). In the assist inspection, first, the switch 39 is turned on, and the pulse selection switch 37 of the piezoelectric element 18*a* corresponding to the inspection target nozzle 23*a* and the pulse selection switches 37 of the piezoelectric elements 18*b* corresponding to the assist nozzles 23*b* on both sides are turned on (FIG. 6A). The pulse selection switches 37 of the other piezoelectric elements 18 other than the piezoelectric elements 18 described above are turned off. Then, the inspection drive pulse Pd is applied to the piezoelectric element 18*a* corresponding to the inspection target nozzle 23*a*. At the same time, the inspection drive pulse Pd is also applied to the piezoelectric elements 18*b* corresponding to the assist nozzles 23*b*. Thereby, these piezoelectric elements 18 are driven at the same time (a second driving step (step S5)), and the pressure variation occurs in the pressure chamber 20 corresponding to the inspection target nozzle 23*a* and in the pressure chambers 20 corresponding to the assist nozzles 23*b* at the same timing. Here, even if a separation occurs on at least one of the upper and lower ends of the partition wall 13 that partitions the pressure chamber 20 of the inspection target nozzle 23*a*, when the inner pressure of the pressure chamber 20 of the inspection target nozzle 23*a* changes, the inner pressure of the pressure chambers 20 adjacent to the above pressure chamber 20 also changes in the same manner, so that the partition wall 13 is prevented from being bent. Thereby, as compared with the single inspection described above, the decrease of the pressure in the pressure chamber 20 of the inspection target nozzle 23*a* is suppressed, so that even if the separation occurs, the pressure vibration of about the same level as that in a normal case occurs in the pressure chamber 20 corresponding to the inspection target nozzle 23*a*.

Subsequently, while the pulse selection switch 37 for the inspection target nozzle 23*a* is maintained to be on, the switch 39 is switched to off by the switching signal and the pulse selection switches 37 of the piezoelectric elements 18 for the assist nozzles 23*b* are switched to off (FIG. 6B). Thereby, only the current Id based on the counter electromotive force of the piezoelectric element 18*a* corresponding to the inspection target nozzle 23*a* flows through the detection resistor 40. In other words, a current based on the counter electromotive force of the piezoelectric elements 18*b* corresponding to the assist nozzles 23*b* does not flow into the detection resistor 40. Then, the vibration detection circuit 38 detects a second counter electromotive force signal Sc2 as a vibration generated by the drive from a potential difference between both ends of the detection resistor 40 described above (a second detection step (step S6)) and outputs the second counter electromotive force signal Sc2 to the CPU 35 of the printer controller 31. Then, the CPU 35 determines the presence or absence of a failure (a separation) of the recording head 2 based on the first counter electromotive force signal Sc1 and the second counter electromotive force signal Sc2 (a separation detection step (step S7)).

Figure 8A:
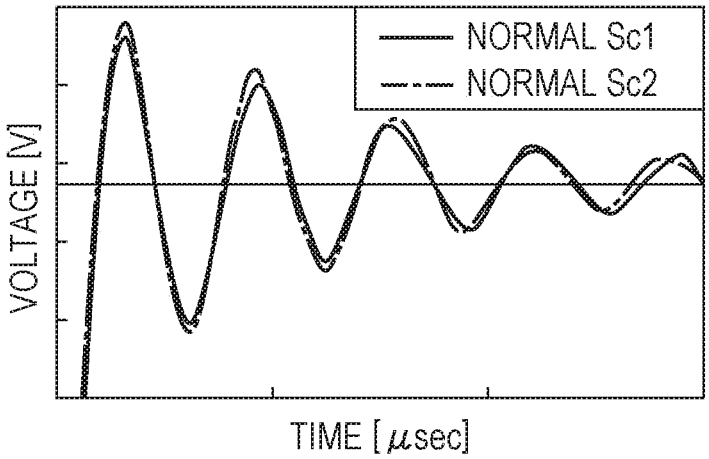
FIGS. 8A to 8C are graphs showing waveforms of a counter electromotive force signal.
Figure 8B:
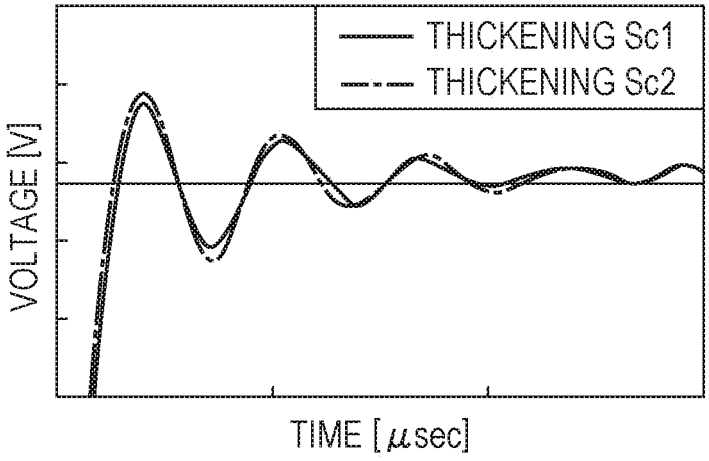
Figure 8C:
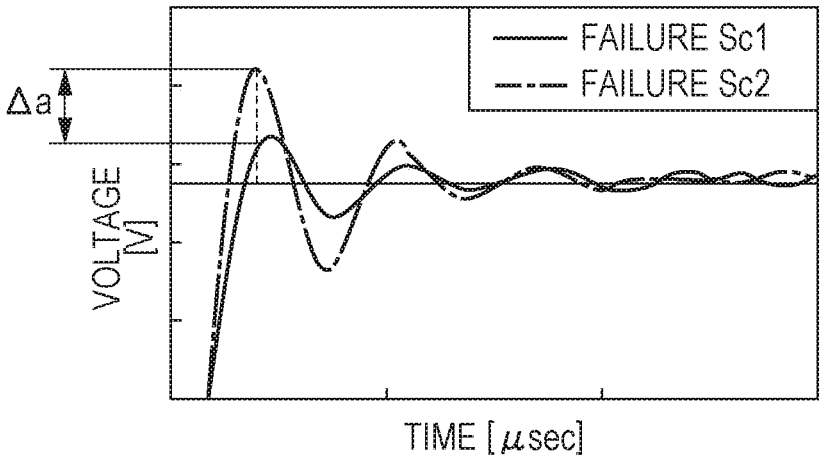

FIGS. 8A to 8C are graphs showing a waveform of the first counter electromotive force signal Sc1 and the second counter electromotive force signal Sc2 which are outputted from the vibration detection circuit 38. FIG. 8A shows a normal case in which a problem due to thickening of ink and/or bubbles or the separation described above does not occur. FIG. 8B shows a case in which a discharge failure occurs due to thickening of ink. FIG. 8C shows a case in which a failure due to the separation occurs. The second counter electromotive force signal Sc2 in FIGS. 8A to 8C shows a waveform obtained when the nozzles 23 located on both sides of the inspection target nozzle 23*a* are driven as the assist nozzles 23*b* during assist drive (that is, when the three nozzles 23 are driven at the same time). As shown in FIG. 8A, in the normal case, relatively large amplitude is obtained in both the first counter electromotive force signal Sc1 and the second counter electromotive force signal Sc2 and a difference between both signals is small. As shown in FIG. 8B, when a discharge failure occurs due to thickening of ink, both the amplitudes of the first counter electromotive force signal Sc1 and the second counter electromotive force signal Sc2 are smaller than those in the normal case. However, the difference between the amplitudes of both signals is not so much different from that in the normal case. However, as shown in FIG. 8C, when a failure occurs due to a separation, although the magnitude of amplitude of the second counter electromotive force signal Sc2 during assist drive is about the same as those of the first counter electromotive force signal Sc1 and the second counter electromotive force signal Sc2 when the ink is thickened, the magnitude of amplitude of the first counter electromotive force signal Sc1 during single drive is significantly lower than that of the second counter electromotive force signal Sc2 because of the reason described above.

Therefore, in step S7, the CPU 35 determines the presence or absence of a failure of the recording head 2 based on a difference between the first counter electromotive force signal Sc1 and the second counter electromotive force signal Sc2, that is, a difference Δa between the amplitudes. Specifically, for example, the CPU 35 compares the obtained difference Δa with a threshold value set in advance. When the difference Δa is greater than or equal to the threshold value, the CPU 35 determines that a failure occurs, that is, a separation between the pressure chamber substrate 14 and another member joined to the pressure chamber substrate 14 occurs, or reduction of adhesive force between them occurs (Yes). On the other hand, when the difference Δa is smaller than the threshold value, the CPU 35 determines that the separation and the like do not occur (No). By sequentially performing such inspection processing on the nozzles 23, it is also possible to roughly identify a failure position based on the difference Δa between the amplitudes of the first counter electromotive force signal Sc1 and the second counter electromotive force signal Sc2. It is possible to perform the determination not only by the difference Δa between the amplitudes of the first counter electromotive force signal Sc1 and the second counter electromotive force signal Sc2, but also by a difference between phases, a difference between periods, or a combination of them. When a separation is detected in step S7, for example, the CPU 35 warns a user by displaying a message indicating that a failure is detected on a liquid crystal display unit provided on the main body of the printer 1 or by displaying a message indicating that a failure is detected through a printer driver or the like executed by a computer connected to the printer 1 (a warning step (step S8)).

As described above, in the printer 1 according to the invention, it is possible to more reliably detect a separation of a member, which has been difficult to detect separately from a trouble of discharge due to thickening, based on a difference between the detection signal related to vibration generated in the ink in the pressure chamber 20 corresponding to the inspection target nozzle 23*a* when only the piezoelectric element 18*a* corresponding to the inspection target nozzle 23*a* is driven and the detection signal related to vibration generated in the ink in the pressure chamber 20 corresponding to the inspection target nozzle 23*a* when the piezoelectric elements 18*a* and 18*b* corresponding to the inspection target nozzle 23*a* and the assist nozzles 23*b* are driven at the same time.

Figure 9:
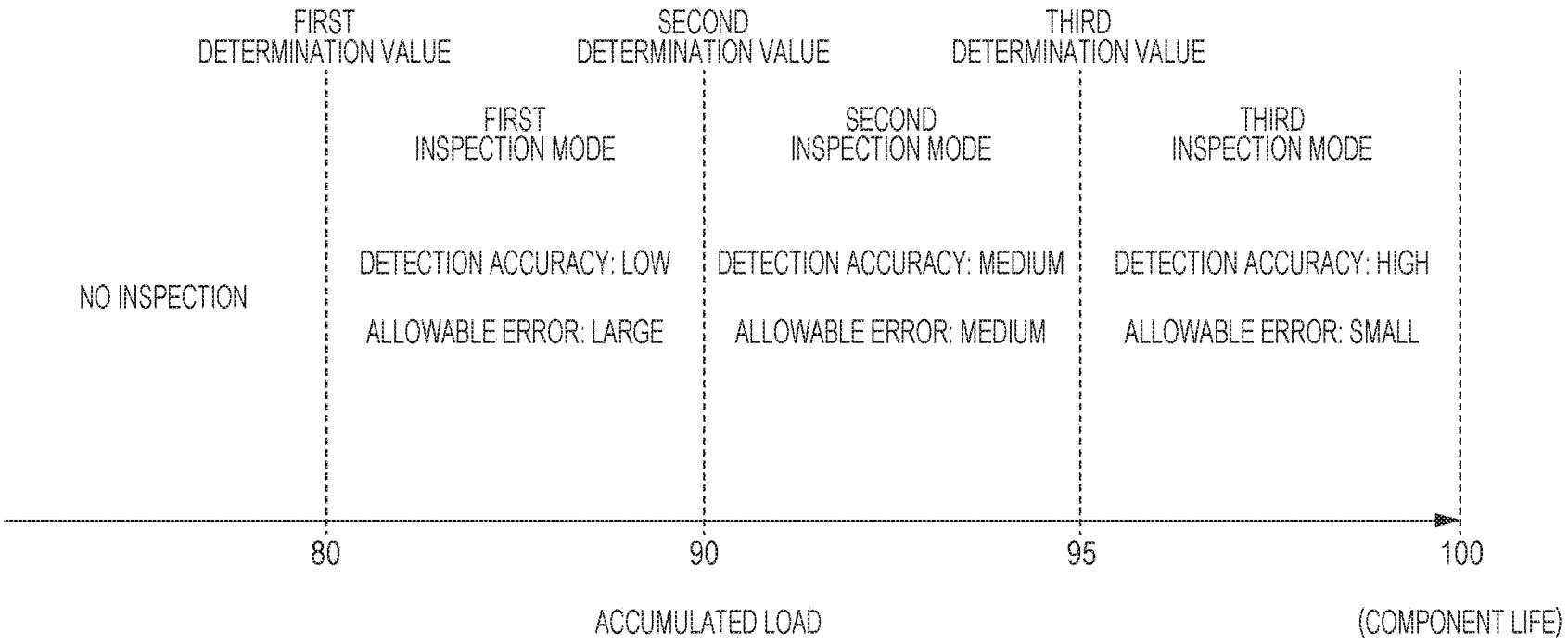
FIG. 9 is a conceptual diagram illustrating inspection processing in a second embodiment of the invention.

FIG. 9 is a conceptual diagram explaining inspection processing in a second embodiment of the invention. A circuit configuration that detects a failure and a configuration of a recording head 2 in the present embodiment are the same as those in the first embodiment. The present embodiment is characteristic in that the closer the accumulated load is to a component life assumed from specification of the recording head 2 (in particular, a life of a portion joined by the adhesive 12), the more the detection accuracy is improved. To improve the detection accuracy, the vibration caused to be generated in the ink in the pressure chamber 20 corresponding to the inspection target nozzle 23*a* is increased, the vibration (residual vibration) caused to be generated in the ink in the pressure chamber 20 corresponding to the assist nozzle 23*b* is increased in order to prevent the bending of the partition wall 13 of the inspection target nozzle 23*a*, the number of the assist nozzles 23*b* that are driven along with the inspection target nozzle 23*a* during assist drive is increased, or a combination of these is performed. It is possible to increase the vibration caused to be generated in the ink in the pressure chamber 20 by, as described later, raising a drive voltage Vd of the inspection drive pulse or changing a waveform of the inspection drive pulse.

However, in a configuration in which the ink is discharged from the nozzles 23 during the inspection, when the number of the assist nozzles 23*b* that are driven at the same time is increased or a greater vibration is caused to be generated in the ink in the pressure chamber 20 in order to improve the detection accuracy, there is a problem that a greater amount of ink is consumed accordingly. Therefore, in the present embodiment, the inspection processing is not performed in an initial stage in which the accumulated load described above is relatively small, and after the accumulated load exceeds a predetermined determination value, the detection accuracy in the inspection processing is sequentially improved according to the accumulated load. More specifically, for example, when the accumulated load is related to time, as shown in FIG. 9, when a period of a component life assumed from specification is defined as 100%, a time point when 80% of the period of the component life has elapsed is defined as a first determination value, a time point when 90% of the period of the component life has elapsed is defined as a second determination value, and a time point when 95% of the period of the component life has elapsed is defined as a third determination value. When the accumulated load is smaller than the first determination value, the inspection processing is not performed, and when the accumulated load reaches each determination value described above, the inspection processing of the recording head 2 is performed. When the accumulated load is the first determination value, the inspection processing is performed in a first inspection mode in which the detection accuracy is set to the lowest of the inspection modes (the detection accuracy: low), and when the accumulated load is the third determination value, the inspection processing is performed in a third inspection mode in which the detection accuracy is set to the highest of the inspection modes. When the accumulated load is the second determination value, the inspection processing is performed in a second inspection mode in which the detection accuracy is set to an accuracy between the detection accuracy in the first inspection mode and the detection accuracy in the third inspection mode. In the present embodiment, the three determination values, which are the first to the third determination values, are set, and accordingly the three inspection modes, which are the first to the third inspection modes, are set. However, it is not limited to this, and it is possible to employ a configuration in which two or four or more determination values are set and accordingly two or four or more inspection modes are provided. Also in this configuration, the detection accuracy may be improved step by step.

The allowable error in determination of separation based on the difference Δa in the separation detection step described above is different for each inspection mode. The smaller the accumulated load is, the relatively greater the allowable error is, and the greater the accumulated load is, the relatively smaller the allowable error is. Specifically, in the inspection modes, failure reference values Bf1 to Bf3 are respectively determined in advance based on examination results and the like as the difference Δa where a failure (a separation) may occur in each inspection mode. Regarding a threshold value Th1 in the first inspection mode, the threshold value Th1 is set to a value greater than the failure reference value Bf1 because the detection accuracy is low in the first inspection mode, and a difference D1 between Th1 and Bf1 (=Th1−Bf1) is the greatest in the inspection modes. Thereby, a certain amount of error is allowed, so that the probability of a false detection, in which a failure is detected even though no error occurs in practice, is reduced. On the other hand, in the third inspection mode, the threshold value Th3 is set to a value close to the failure reference value Bf1 as much as possible, and a difference D3 between Th3 and Bf3 (=Th3−Bf3) is the smallest in the inspection modes. In other words, in the third inspection mode, the allowable error is set to the smallest in the inspection modes. Thereby, the detection accuracy is further improved. In the second inspection mode, a difference D2 between the threshold value Th2 and the failure reference value Bf2 (=Th2−Bf2) is set to a value between the difference D1 in the first inspection mode and the difference D3 in the third inspection mode.

Figure 11:
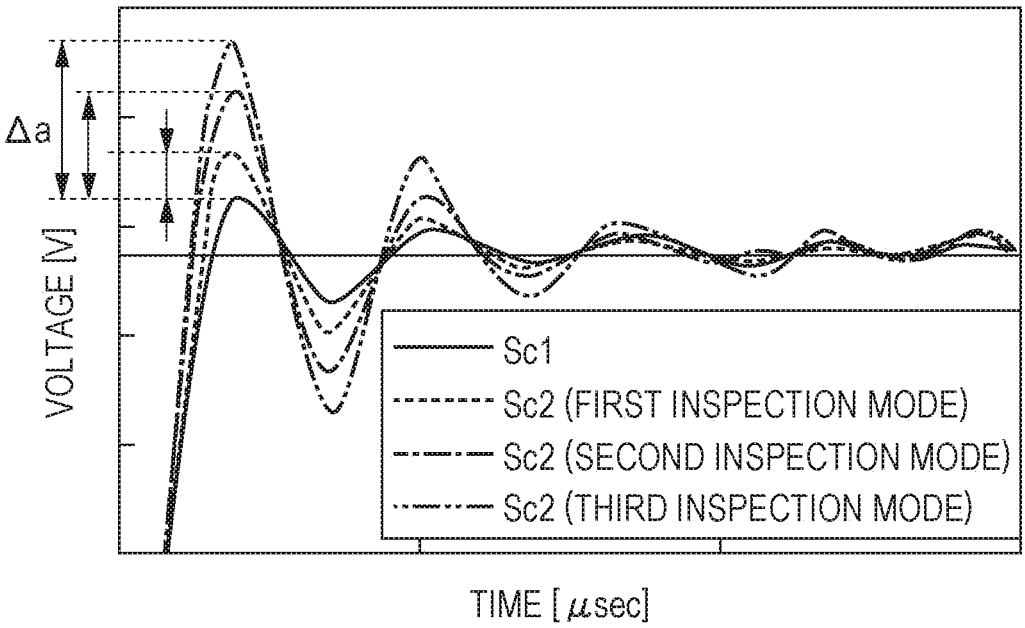
FIG. 11 is a graph showing waveforms of a first counter electromotive force signal and a second counter electromotive force signal which are outputted from a vibration detection circuit.

FIG. 10 is a table showing a specific example of the inspection processing in the present embodiment. FIG. 11 is a graph showing a waveform of the first counter electromotive force signal Sc1 (during single inspection/single driving) and a waveform of the second counter electromotive force signal Sc2 (during assist inspection/assist driving) which are outputted from the vibration detection circuit 38. In FIG. 11, the solid line represents a waveform when the inspection target nozzle 23*a* is separately driven and the broken line represents a waveform during the assist driving in the first inspection mode. Further, in FIG. 11, the chain line represents a waveform during the assist driving in the second inspection mode and the two-dot chain line represents a waveform during the assist driving in the third inspection mode. Regarding the graph in FIG. 11, substantially the same result is obtained in each of the examples A to E in FIG. 10.

In FIG. 10, in the example shown in A, the inspection drive pulse Pd shown in FIG. 4 is used for both the inspection target nozzle 23*a* and the assist nozzle 23*b*. The inspection drive pulse Pd can generate the greatest vibration in the ink in the pressure chamber 20 as compared with the other drive pulses described later and can generate the largest ink droplet discharged from the nozzle 23. The number of the assist nozzles 23*b* that are driven along with the inspection target nozzle 23*a* is two (the assist nozzles 23*b* at both sides of the inspection target nozzle 23*a*) in any of the inspection modes. In the example A, the drive voltage Vd (see FIG. 4) of the inspection drive pulse Pd applied to the piezoelectric element 18*a* corresponding to the inspection target nozzle 23*a* is different for each inspection mode. Specifically, in the first inspection mode, the drive voltage Vd is set to the lowest value (small) among the inspection modes, in the third inspection mode, the drive voltage Vd is set to the highest value (large) among the inspection modes, and in the second inspection mode, the drive voltage Vd is set to a value (medium) between the drive voltage Vd in the first inspection mode and the drive voltage Vd in the third inspection mode.

In this way, in the example A, the drive voltage Vd of the inspection drive pulse Pd is raised step by step from the first inspection mode to the third inspection mode. Here, if a separation occurs on at least one of the upper and lower ends of the partition wall 13 that partitions the pressure chamber 20 of the inspection target nozzle 23*a*, the partition wall 13 easily bends. Therefore, in the single inspection in which only the inspection target nozzle 23*a* is driven, the amplitude and the like of the first counter electromotive force signal Sc1 hardly change regardless of the height of the drive voltage Vd of the inspection drive pulse Pd. On the other hand, in the assist inspection, the pressure in the pressure chamber 20 of the inspection target nozzle 23*a* is difficult to escape by the drive of the assist nozzles 23*b*, so that the amplitude of the second counter electromotive force signal Sc2 increases in order of the first inspection mode, the second inspection mode, and the third inspection mode according to the drive voltage Vd of the inspection drive pulse Pd. Thereby, the difference Δ between the first counter electromotive force signal Sc1 and the second counter electromotive force signal Sc2 increases in order of the first inspection mode, the second inspection mode, and the third inspection mode. Therefore, the detection accuracy of a failure (a separation) increases in order of the first inspection mode, the second inspection mode, and the third inspection mode.

When the accumulated load is the first determination value, the inspection processing is performed in the first inspection mode in which the detection accuracy is set to the lowest of the detection modes. When the accumulated load is the third determination value, the inspection processing is performed in the third inspection mode in which the detection accuracy is set to the highest of the detection modes. When the accumulated load is the second determination value, the inspection processing is performed in the second inspection mode in which the detection accuracy is set to an accuracy between the detection accuracy in the first inspection mode and the detection accuracy in the third inspection mode. In the example A, the drive voltage Vd of the inspection drive pulse Pd applied to the piezoelectric element 18*b* corresponding to the assist nozzle 23*b* is set to a constant value (for example, intermediate) in any of the inspection modes.

In the first inspection mode, it is possible to efficiently detect the separation while suppressing useless consumption of the ink. Specifically, the smaller the accumulated loads, the smaller the possibility of generation of separation, so that the detection accuracy can be lowered. Therefore, it is possible to reduce the amount of ink discharged from the nozzles 23*a* and 23*b*. Thereby, it is possible to reduce the amount of ink consumed in the inspection processing. Further, a certain amount of error is allowed for the difference Δ between the first counter electromotive force signal Sc1 and the second counter electromotive force signal Sc2, so that false detection is suppressed. On the other hand, the greater the accumulated load, the higher the possibility of generation of separation. Therefore, in the second inspection mode and the third inspection mode, the drive voltage Vd of the inspection drive pulse Pd is raised sequentially from the first inspection mode, so that it is possible to improve the detection accuracy of the separation.

Figure 12:
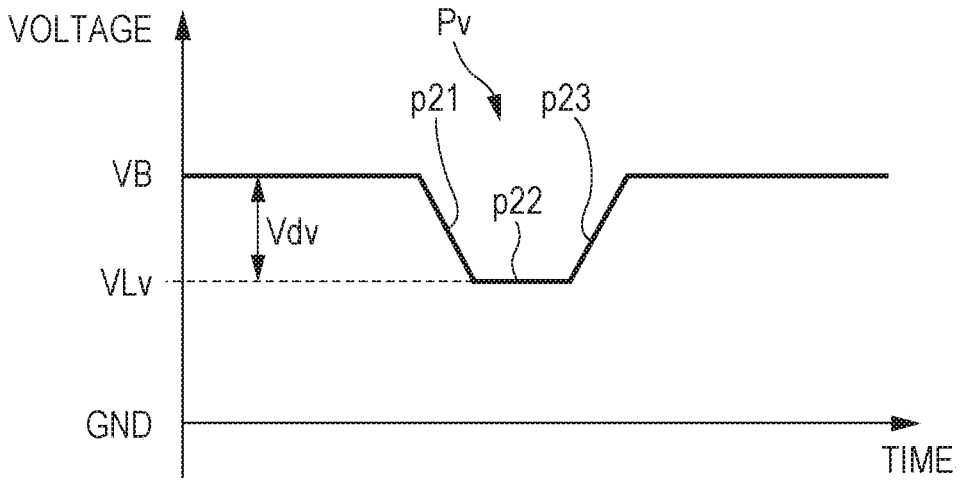
FIG. 12 is a waveform chart showing an example of a waveform of a micro vibration drive pulse.
Figure 13:
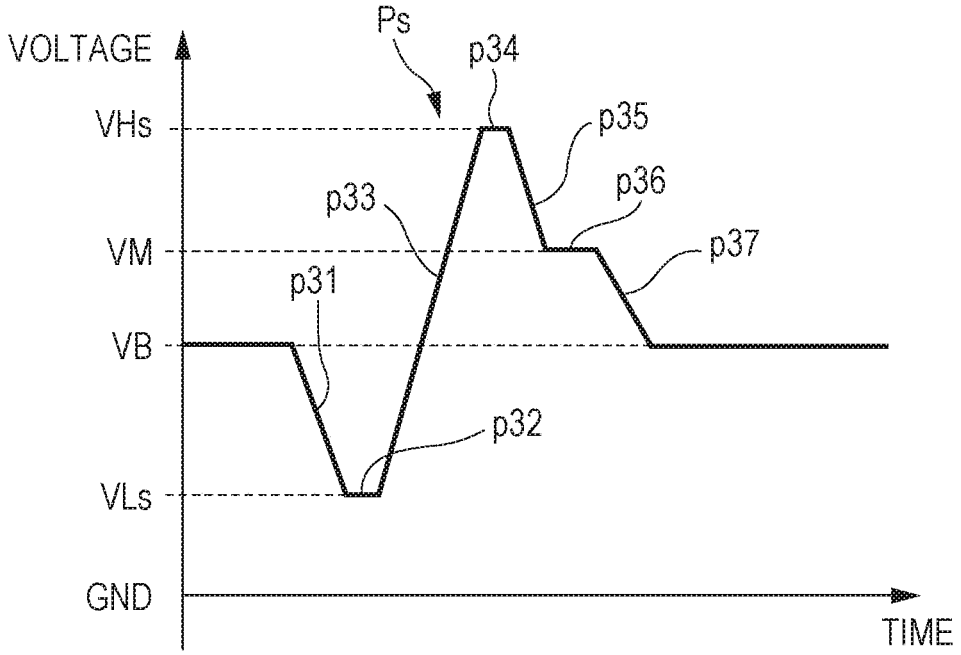
FIG. 13 is a waveform chart showing an example of a waveform of a small dot drive pulse.

In FIG. 10, the example shown in B is different from the example A in a point that the inspection drive pulse is different for each inspection mode. FIG. 12 is a waveform chart showing an example of a micro vibration drive pulse Pv used as an inspection drive pulse. FIG. 13 is a waveform chart showing an example of a small dot drive pulse Ps also used as an inspection drive pulse. In the first inspection mode of the example B, the micro vibration drive pulse Pv shown in FIG. 12 is used as the inspection drive pulse of the inspection target nozzle 23*a*. The micro vibration drive pulse Pv includes a preliminary expansion element p21, an expansion hold element p22, and a return element p23. The preliminary expansion element p21 is a waveform element where the potential changes toward the ground potential GND from the reference potential VB to the expansion potential VLv. The expansion hold element p22 is a waveform element where the expansion potential VLv which is a terminal potential of the preliminary expansion element p21 is maintained for a certain period of time. The return element p23 is a waveform element where the potential changes toward the plus side from the expansion potential VLv to the reference potential VB. The micro vibration drive pulse Pv is a drive pulse whose waveform and drive voltage are set in order to generate a pressure vibration in the ink in the pressure chamber 20 within a range where the ink is not discharged from the nozzle 23. In other words, among all the inspection drive pulses, the micro vibration drive pulse Pv causes the smallest vibration in the ink in the pressure chamber 20.

In the second inspection mode of the example B, the small dot drive pulse Ps shown in FIG. 13 is used as the inspection drive pulse of the inspection target nozzle 23*a*. The small dot drive pulse Ps includes a preliminary expansion element p31, an expansion hold element p32, a contraction element p33, a contraction hold element p34, an early stage expansion element p35, an intermediate hold element p36, and a later stage expansion element p37. The preliminary expansion element p31 is a waveform element where the potential changes toward the ground potential GND from the reference potential VB to the expansion potential VLs. The expansion hold element p32 is a waveform element where the expansion potential VLs which is a terminal potential of the preliminary expansion element p31 is maintained for a certain period of time. The contraction element p33 is a waveform element where the potential changes toward the plus side with a relatively steep gradient from the expansion potential VLs to the contraction potential VHs through the reference potential VB. The early stage expansion element p35 is a waveform element where the potential changes toward the ground potential GND from the contraction potential VHs to the intermediate potential VM (VB<VM<VHs). The intermediate hold element p36 is a waveform element where the intermediate potential VM which is a terminal potential of the early stage expansion element p35 is maintained for a certain period of time. The later stage expansion element p37 is a waveform element where the potential changes toward the ground potential GND from the intermediate potential VM to the reference potential VB. The small dot drive pulse Ps is a drive pulse where the amount of ink discharged from the nozzle 23 is set to be smaller than that discharged by the inspection drive pulse Pd. In other words, the small dot drive pulse Ps is a drive pulse where the vibration generated in the ink in the pressure chamber 20 is greater than that generated by the micro vibration drive pulse Pv and is smaller than that generated by the inspection drive pulse Pd.

In the example B, the micro vibration drive pulse Pv is used for any of the assist nozzles 23*b*. In the same manner as in the example A, the number of the assist nozzles 23*b* that are driven along with the inspection target nozzle 23*a* is two (the assist nozzles 23*b* at both sides of the inspection target nozzle 23*a*). In the example B, as the inspection drive pulse of the inspection target nozzle 23*a*, the micro vibration drive pulse Pv is used in the first inspection mode, the small dot drive pulse Ps is used in the second inspection mode, and the inspection drive pulse Pd is used in the third inspection mode, so that the detection accuracy is improved step by step. Also in the example B, in the same manner as in the example A, it is possible to efficiently detect a separation according to the accumulated load while suppressing useless consumption of the ink.

In FIG. 10, in the example shown in C, the inspection drive pulse Pd whose drive voltage Vd is constant is used for the inspection target nozzle 23*a* in any inspection mode. The micro vibration drive pulse Pv is used for the assist nozzles 23*b*. The number of the assist nozzles 23*b* that are driven along with the inspection target nozzle 23*a* is two (the assist nozzles 23*b* at both sides of the inspection target nozzle 23*a*) in any of the inspection modes. In the example C, the drive voltage Vdv (see FIG. 12) of the micro vibration drive pulse Pv applied to the piezoelectric element 18*b* corresponding to the assist nozzle 23*b* is different for each inspection mode. Specifically, in the first inspection mode, the drive voltage Vdv is set to the lowest value (small) among the inspection modes, in the third inspection mode, the drive voltage Vdv is set to the highest value (large) among the inspection modes, and in the second inspection mode, the drive voltage Vdv is set to a value (medium) between a value of the drive voltage Vdv in the first inspection mode and a value of the drive voltage Vdv in the third inspection mode. In this way, the drive voltage Vdv of the micro vibration drive pulse Pv is raised step by step from the first inspection mode to the third inspection mode, so that the partition wall 13 of the pressure chamber 20 of the inspection target nozzle 23*a* is prevented from being deformed (bent) during the assist inspection and the detection accuracy is improved step by step. Also in the example C, in the same manner as in the example A, it is possible to efficiently detect a separation according to the accumulated load while suppressing useless consumption of the ink.

In FIG. 10, in the example shown in D, the inspection drive pulse Pd is used for the inspection target nozzle 23*a* in any inspection mode and the inspection drive pulse Pd is also used for the assist nozzles 23*b*. The number of the assist nozzles 23*b* that are driven along with the inspection target nozzle 23*a* is two (the assist nozzles 23*b* at both sides of the inspection target nozzle 23*a*) in any of the inspection modes. In the example D, the drive voltage Vd of the inspection drive pulse Pd for the inspection target nozzle 23*a* and the inspection drive pulse Pd for the assist nozzles 23*b* is different for each inspection mode. Specifically, in the first inspection mode, the drive voltage Vd of the inspection drive pulse Pd for the inspection target nozzle 23*a* and the drive voltage Vd of the inspection drive pulse Pd for the assist nozzles 23*b* are set to the lowest values (small) among the inspection modes. In the third inspection mode, the drive voltage Vd of the inspection drive pulse Pd for the inspection target nozzle 23*a* and the drive voltage Vd of the inspection drive pulse Pd for the assist nozzles 23*b* are set to the highest values (large) among the inspection modes. In the second inspection mode, the drive voltage Vd of the inspection drive pulse Pd for the inspection target nozzle 23*a* and the drive voltage Vd of the inspection drive pulse Pd for the assist nozzles 23*b* are set to a value (medium) between a value of the drive voltage Vd in the first inspection mode and a value of the drive voltage Vd in the third inspection mode. In the example D, the drive voltage Vd of the inspection drive pulse Pd for the inspection target nozzle 23*a* is raised step by step from the first inspection mode to the third inspection mode, and accordingly the drive voltage Vd of the inspection drive pulse Pd for the assist nozzles 23*b* is raised step by step from the first inspection mode to the third inspection mode. Thereby, the bending of the partition wall 13 of the pressure chamber 20 of the inspection target nozzle 23*a* is more reliably prevented, so that it is possible to more accurately detect a separation according to the accumulated load.

In FIG. 10, in the example shown in E, the inspection drive pulse Pd is used for the inspection target nozzle 23*a* in any inspection mode and the inspection drive pulse Pd is also used for the assist nozzles 23*b*. The number of the assist nozzles 23*b* that are driven along with the inspection target nozzle 23*a* is two (a total of two nozzles that are the nozzles 23*b* at both sides of the inspection target nozzle 23*a*) in the first inspection mode and the second inspection mode, and is four (a total of four nozzles that are the nozzles 23*b* at both sides of the inspection target nozzle 23*a* and nozzles 23*b* further adjacent to these nozzles 23*b*). The drive voltage Vd of the inspection drive pulse Pd for the inspection target nozzle 23*a* and the inspection drive pulse Pd for the assist nozzles 23*b* is set to the lowest value (small) in the first inspection mode among the inspection modes and is set to the highest value (large) in the second inspection mode and the third inspection mode. In the example E, in the second inspection mode, the drive voltage Vd of the inspection drive pulse Pd for the inspection target nozzle 23*a* and the inspection drive pulse Pd for the assist nozzles 23*b* is raised more than that in first inspection mode, so that the detection accuracy is improved. In the third inspection mode, the number of the assist nozzles 23*b* is increased to four from two of the second inspection mode, so that the detection accuracy of a separation is improved. In this way, also in the example E, it is possible to detect a separation more accurately while suppressing false detection according to the accumulated load.

When changing the drive voltage of the inspection drive pulse, the waveform of the inspection drive pulse, or the number of the assist nozzles 23*b* according to the accumulated load, or combining these changes, it is possible to efficiently detect a failure (a separation) while suppressing useless consumption of ink. In other words, the smaller the accumulated load, the smaller the possibility of generation of separation, so that it is possible to suppress useless consumption of ink by reducing the amount of ink discharged from the nozzles 23 during the inspection by reducing the pressure generated in the pressure chamber 20 or causing no ink to be discharged. On the other hand, the greater the accumulated load, the higher the possibility of generation of separation. Therefore, it is possible to improve the detection accuracy of the separation by raising the drive voltage of the inspection drive pulse, changing the waveform of the inspection drive pulse to a waveform having a higher driving force (a waveform that causes a greater vibration in the ink in the pressure chamber 20), increasing the number of the assist nozzles 23*b*, or combining these methods. The smaller the accumulated load, the smaller the possibility that a separation occurs, so that false detection is suppressed by setting a relatively large allowable error in determination of separation in the separation detection step. On the other hand, the greater the accumulated load, the greater the possibility that a separation occurs, so that it is possible to improve the detection accuracy of the separation by setting a relatively small allowable error in determination of separation in the separation detection step.

Further, the inspection processing is performed when the accumulated loads related to the generation of separation exceed a predetermined determination value, so that it is possible not to perform the inspection processing in an initial stage in which the possibility of generation of separation is relatively small. Therefore, it is possible to reduce the processing time accordingly. When the ink is discharged from the nozzles 23 in the inspection processing, it is possible to reduce useless consumption of the ink. Further, a warning is issued to a user when a separation is detected in the separation detection step, so that the user can immediately know that the separation occurs. Therefore, it is possible to quickly perform a countermeasure such as repair and replacement.

This is applied not only to a case in which the operating time is used as the accumulated loads, but also to a case in which the integrated value of the number of times of discharge or the like is used as the accumulated loads. That is to say, the greater the accumulated load, the more accurately the detection of separation can be performed while suppressing useless consumption of ink and false detection by raising the drive voltage of the inspection drive pulse, changing the waveform of the inspection drive pulse to a waveform having a higher driving force, increasing the number of the assist nozzles 23*b*, or combining these methods.

In the embodiments described above, the pressure chamber substrate 14, that is, a configuration in which the elastic film 16 and the nozzle plate 15 are respectively joined to the upper end and the lower end of the partition wall 13 of the pressure chamber 20, is illustrated. However, the embodiments are not limited to this, and a configuration in which members different from those in the embodiments described above are joined to the upper end and the lower end of the partition wall 13 of the pressure chamber 20 can be applied in the same manner.

Further, although the piezoelectric element 18 is illustrated as an actuator in the embodiments described above, the actuator is not limited to this, and it is possible to employ various actuators such as, for example, a heater element and an electrostatic actuator.

The invention can be applied not only to printers, but also to liquid discharge devices, which have a configuration to discharge liquid from nozzles by pressure vibration generated in liquid in a pressure chamber by driving actuators, such as various types of ink jet recording devices including a plotter, a facsimile machine, and a copy machine, and liquid discharge devices other than recording devices, such as, for example, a display manufacturing device, an electrode manufacturing device, and a chip manufacturing device.

The entire disclosure of Japanese Patent Application No.:2015-007387, filed Jan. 19, 2015 and 2015-226569, filed Nov. 19, 2015 are expressly incorporated by reference herein.

What is claimed is:

1. An inspection method of a liquid discharge head including a liquid discharge head which has a plurality of nozzles arranged in parallel, a substrate in which a plurality of pressure chambers respectively communicating with the nozzles are formed by being separated by partition walls, and actuators that cause pressure vibration in liquid in the pressure chambers and which discharges liquid from the nozzles by driving of the actuators, and a detection circuit that detects vibration in the liquid in the pressure chamber generated by the driving of the actuator, the inspection method performing:

inspection processing including a first driving step of driving a first actuator corresponding to an inspection target nozzle, a first detection step of detecting vibration that is generated in liquid in a pressure chamber corresponding to the inspection target nozzle by the driving in the first driving step, a second driving step of driving together the first actuator and a second actuator corresponding to at least one nozzle of nozzles adjacent to the inspection target nozzle, a second detection step of detecting vibration that is generated in the liquid in the pressure chamber corresponding to the inspection target nozzle by the driving in the second driving step, and a separation detection step of detecting separation of a member joined to the partition wall based on a difference between a detection result of the first detection step and a detection result of the second detection step.

2. The inspection method of a liquid discharge head according to claim 1, wherein the inspection processing is performed when an accumulated load related to generation of the separation exceeds a predetermined determination value.

3. The inspection method of a liquid discharge head according to claim 2, wherein the greater the accumulated load, the greater the number of the second actuators that are driven together with the first actuator of the inspection target nozzle in the second driving step.

4. The inspection method of a liquid discharge head according to claim 2, wherein the smaller the accumulated load, the relatively greater an allowable error in determination of separation in the separation detection step, and the greater the accumulated load, the relatively smaller an allowable error in determination of separation in the separation detection step.

5. The inspection method of a liquid discharge head according to claim 1, further comprising:

a warning step of issuing a warning to a user when the separation is detected in the separation detection step.

6. The inspection method of a liquid discharge head according to claim 1, wherein when driving the actuators in the first driving step and the second driving step, liquid is discharged from nozzles corresponding to the actuators.

7. A liquid discharge device comprising:

a liquid discharge head including a plurality of nozzles arranged in parallel, a substrate in which a plurality of pressure chambers respectively communicating with the nozzles are formed by being separated by partition walls, and actuators that cause pressure vibration in liquid in the pressure chambers;

a detection circuit that detects vibration in the liquid in the pressure chamber generated by driving of the actuator; and a control circuit that controls discharge of liquid from the nozzles by driving the actuators, wherein the control circuit drives a first actuator corresponding to an inspection target nozzle and detects vibration generated in liquid in a pressure chamber corresponding to the inspection target nozzle as a first detection result, drives together the first actuator and a second actuator corresponding to at least one nozzle of nozzles adjacent to the inspection target nozzle and detects vibration generated in the liquid in the pressure chamber corresponding to the inspection target nozzle as a second detection result, and detects separation of a member joined to the partition wall based on a difference between the first detection result and the second detection result.

8. The liquid discharge device of claim 7, wherein the control circuit drives the first actuator, drives together the first actuator and the second actuator, and detects separation of a member joined to the partition wall responsive to detecting that an accumulated load related to generation of the separation exceeds a predetermined determination value.

9. The liquid discharge device of claim 8, wherein the greater the accumulated load, the greater the number of the second actuators that are driven together with the first actuator of the inspection target nozzle in the second driving step.

10. The liquid discharge device of claim 8, wherein the smaller the accumulated load, the relatively greater an allowable error in determination of separation in the separation detection step, and the greater the accumulated load, the relatively smaller an allowable error in determination of separation in the separation detection step.

* * * * *